US009239180B2

(12) United States Patent
Ochiai et al.

(10) Patent No.: US 9,239,180 B2
(45) Date of Patent: Jan. 19, 2016

(54) REFRIGERATION AND AIR-CONDITIONING APPARATUS

(75) Inventors: Yasutaka Ochiai, Tokyo (JP); Kosuke Tanaka, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 897 days.

(21) Appl. No.: 13/498,367

(22) PCT Filed: Apr. 21, 2010

(86) PCT No.: PCT/JP2010/002866

§ 371 (c)(1),
(2), (4) Date: Mar. 27, 2012

(87) PCT Pub. No.: WO2011/048721

PCT Pub. Date: Apr. 28, 2011

(65) Prior Publication Data

US 2012/0180506 A1 Jul. 19, 2012

(30) Foreign Application Priority Data

Oct. 23, 2009 (JP) ..... 2009-244133

(51) Int. Cl.

*F25B 49/02* (2006.01)
*F25B 49/00* (2006.01)
*F24F 11/00* (2006.01)

(52) U.S. Cl.

CPC ..... *F25B 49/005* (2013.01); *F24F 2011/0084* (2013.01); *F25B 2345/003* (2013.01); (Continued)

(58) Field of Classification Search

CPC ..... F25B 45/00; F25B 2345/00; F25B 2345/003; F25B 2500/222; F25B 2600/05; F25B 2700/04; F24F 2011/0084

USPC ..... 62/77, 149, 292

See application file for complete search history.

(56) References Cited

U.S. PATENT DOCUMENTS 4,149,574 A 4/1979 Lehmann et al.
4,367,637 A 1/1983 Paulokat (Continued)

FOREIGN PATENT DOCUMENTS

CN 101156033 A 4/2008
CN 101326416 A 12/2008

(Continued)

OTHER PUBLICATIONS

Office Action issued on Sep. 15, 2014, by the Chinese Patent Office in corresponding Chinese Patent Application No. 201080047641.2 and an English translation of the Office Action. (14 pages).

(Continued)

*Primary Examiner* — Jonathan Bradford

(74) *Attorney, Agent, or Firm* — Buchanan Ingersoll & Rooney PC

(57) ABSTRACT

When an operating state indicated by a set of operation data measured during normal operation becomes a state satisfying an operation data obtaining condition, the set of operation data at the time is obtained as a set of operation data for initial learning, and an inner volume of a refrigerant extension piping is calculated based on the obtained set of operation data for initial learning. A total amount of refrigerant in a refrigerant circuit 10 is calculated based on the calculated inner volume of the refrigerant extension piping and the current set of operation data, and the calculated total refrigerant is compared with a reference amount of refrigerant to determine a presence or absence of refrigerant leakage.

14 Claims, 6 Drawing Sheets

(52) U.S. Cl.
CPC ..... *F25B2400/13* (2013.01); *F25B 2500/222* (2013.01); *F25B 2600/05* (2013.01); *F25B 2700/04* (2013.01)

(56) References Cited

U.S. PATENT DOCUMENTS

| | | | |
|---|---|---|---|
| 4,688,388 | A | 8/1987 | Lower et al. |
| 4,711,096 | A | 12/1987 | Krantz |
| 5,009,076 | A | 4/1991 | Winslow |
| 5,142,876 | A | 9/1992 | Snider et al. |
| 7,640,758 | B2 | 1/2010 | Esslinger |
| 2002/0139128 | A1 | 10/2002 | Suzuki et al. |
| 2002/0152759 | A1 | 10/2002 | Brass et al. |
| 2004/0055317 | A1 | 3/2004 | Nomura et al. |
| 2005/0072168 | A1 | 4/2005 | Beatenbough et al. |
| 2005/0086951 | A1 | 4/2005 | Dobmeier et al. |
| 2005/0109050 | A1 | 5/2005 | Laboe et al. |
| 2005/0126190 | A1 | 6/2005 | Lifson et al. |
| 2006/0137364 | A1 | 6/2006 | Braun, II et al. |
| 2006/0137368 | A1 | 6/2006 | Kang et al. |
| 2009/0025406 | A1 | 1/2009 | Yoshimi et al. |
| 2009/0100849 | A1 | 4/2009 | Nishimura et al. |
| 2009/0126379 | A1 | 5/2009 | Yamaguchi et al. |
| 2009/0314017 | A1 | 12/2009 | Nishimura et al. |
| 2010/0300129 | A1 | 12/2010 | Bean, Jr. et al. |
| 2011/0308267 | A1 | 12/2011 | Tamaki et al. |
| 2011/0314854 | A1 | 12/2011 | Sata et al. |
| 2012/0180506 | A1 | 7/2012 | Ochiai et al. |
| 2013/0067942 | A1 | 3/2013 | Ochiai et al. |
| 2014/0174114 | A1 | 6/2014 | Tamaki et al. |

FOREIGN PATENT DOCUMENTS

| | | | |
|---|---|---|---|
| CN | 101473177 | A | 7/2009 |
| EP | 1970652 | A1 * | 9/2008 |
| JP | 56-80660 | A | 7/1981 |
| JP | 2007-163099 | A | 6/2007 |
| JP | 2007-163102 | A | 6/2007 |
| JP | 2008-51496 | A | 3/2008 |
| JP | 2008-64453 | A | 3/2008 |
| JP | 4155313 | B2 | 9/2008 |
| JP | 2008-232579 | A | 10/2008 |
| JP | 2009-139012 | A | 6/2009 |
| WO | WO 2008/035418 | A1 | 3/2008 |

OTHER PUBLICATIONS

International Search Report (PCT/ISA/210) issued on Aug. 3, 2010, by Japanese Patent Office as the International Searching Authority for International Application No. PCT/JP2010/002866.

Japanese Office Action issued by the Japanese Patent Office in connection with JP 2009-244133 on Sep. 13, 2011, and English translation thereof (4 pages).

Japanese Office Action (Notification of Reasons for Refusal) dated Jun. 19, 2012, issued in corresponding Japanese Patent Application No. 2009-244133. (4 pages).

Office Action (Notification of the First Office Action) issued on Dec. 26, 2013, by the Chinese Patent Office in corresponding Chinese Patent Application No. 201080047641.2, and an English Translation of the Office Action. (14 pages).

International Search Report (PCT/ISA-210) issued Apr. 20, 2010 by the Japanese Patent Office in corresponding International Application No. PCT/JP2010/001778 (2 pages).

Office Action (Notice of Reasons for Rejection) issued Sep. 24, 2013 by the Japanese Patent Office in corresponding Japanese Patent Application No. 2012-504156, and an English translation thereof (5 pages).

Office Action (Notification of the First Office Action) issued Mar. 7, 2014 by the Chinese Patent Office in corresponding Chinese Patent Application No. 201080065367.1, and an English translation thereof (16 pages).

* cited by examiner

REFRIGERATION AND AIR-CONDITIONING APPARATUS

TECHNICAL FIELD

The present invention relates to implementing with higher accuracy a function of calculating an amount of refrigerant in a refrigerant circuit in a refrigeration and air-conditioning apparatus configured by connecting an outdoor unit that is a heat source to an indoor unit that is a use side through refrigerant extension piping.

BACKGROUND ART

Conventionally, in a split type refrigeration and air-conditioning apparatus configured by connecting an outdoor unit that is a heat source device to an indoor unit that is a use side through refrigerant extension piping, there is a technique of calculating an inner volume of the refrigerant extension piping by implementing an extension piping inner volume determining operation (two operations with different densities in the refrigerant extension piping during cooling operation), by calculating the change in amount of refrigerant in the two operating state other than the refrigerant in the refrigerant extension piping, and by dividing the amount of change by amount of density change in the refrigerant extension piping, and calculating an amount of refrigerant in the refrigerant extension piping by using the inner volume of the refrigerant extension piping (see, e.g., Patent Literature 1).

CITATION LIST

Patent Literature

Patent Literature 1: Japanese Unexamined Patent Publication No. 2007-163102 (Abstract)

SUMMARY OF INVENTION

Technical Problem

However, in the above-described refrigerant extension piping inner volume estimating method, since a special operation is executed, i.e., the extension piping inner volume determining operation, when calculating an inner volume of the extension piping at the time of installation of a refrigeration and air-conditioning apparatus, much work is required and it is difficult to execute the extension piping inner volume determining operation to existing refrigeration and air-conditioning apparatus.

The present invention was made in view of these points and an object of the invention is to obtain a refrigeration and air-conditioning apparatus capable of accurately calculating an inner volume of a refrigerant extension piping by using a set of operation data obtained during normal operation and capable of calculating with high accuracy a total amount of refrigerant in a refrigerant circuit and detecting refrigerant leakage.

Solution to Problem

A refrigeration and air-conditioning apparatus including: a refrigerant circuit including an outdoor unit that is a heat source unit and an indoor unit that is a use side unit connected through refrigerant extension piping; a measuring unit that measures temperature and pressure of a main portion of the refrigerant circuit as operation data; a calculating unit that has an operation data obtaining condition specifying an operating state and obtains, upon satisfaction of the operation data obtaining condition with respect to an operating state indicated by a set of operation data measuring unit during normal operation, the set of operation data at that time as a set of operation data for initial learning, the calculating unit calculating an inner volume of the refrigerant extension piping based on the obtained set of operation data for the initial learning and an initial charging amount that is a charging amount of refrigerant at the initial installation time of the refrigeration and air-conditioning apparatus, the calculating unit calculating a reference amount of refrigerant that is a criterion for determining refrigerant leakage from the refrigerant circuit based on the calculated inner volume of the refrigerant extension piping and the set of operation data for the initial learning; and a determining unit that calculates a total amount of refrigerant in the refrigerant circuit based on the inner volume of the refrigerant extension piping calculated by the calculating unit and a set of operation data measured by the measuring unit during normal operation, the determining unit comparing the calculated total amount of refrigerant with the reference amount of refrigerant to determine a presence or absence of refrigerant leakage.

Advantageous Effects of Invention

According to the invention, an inner volume of the refrigerant extension piping can be calculated from the set of operation data during normal operation without the special operation not only for a newly installed refrigeration and air-conditioning apparatus but also for an existing refrigeration and air-conditioning apparatus. Since the inner volume of the refrigerant extension piping is calculated by using the set of operation data during an operating state satisfying an operation data obtaining condition, the inner volume of the refrigerant extension piping can be calculated with high accurately, thereby enabling accurate calculation of the total amount of refrigerant and detection of refrigerant leakage in the refrigeration and air-conditioning apparatus.

DESCRIPTION OF EMBODIMENTS

Embodiment 1

An embodiment of a refrigeration and air-conditioning apparatus according to the invention will be described hereinafter with reference to the drawings.

<Configuration of Devices>

Figure 1:
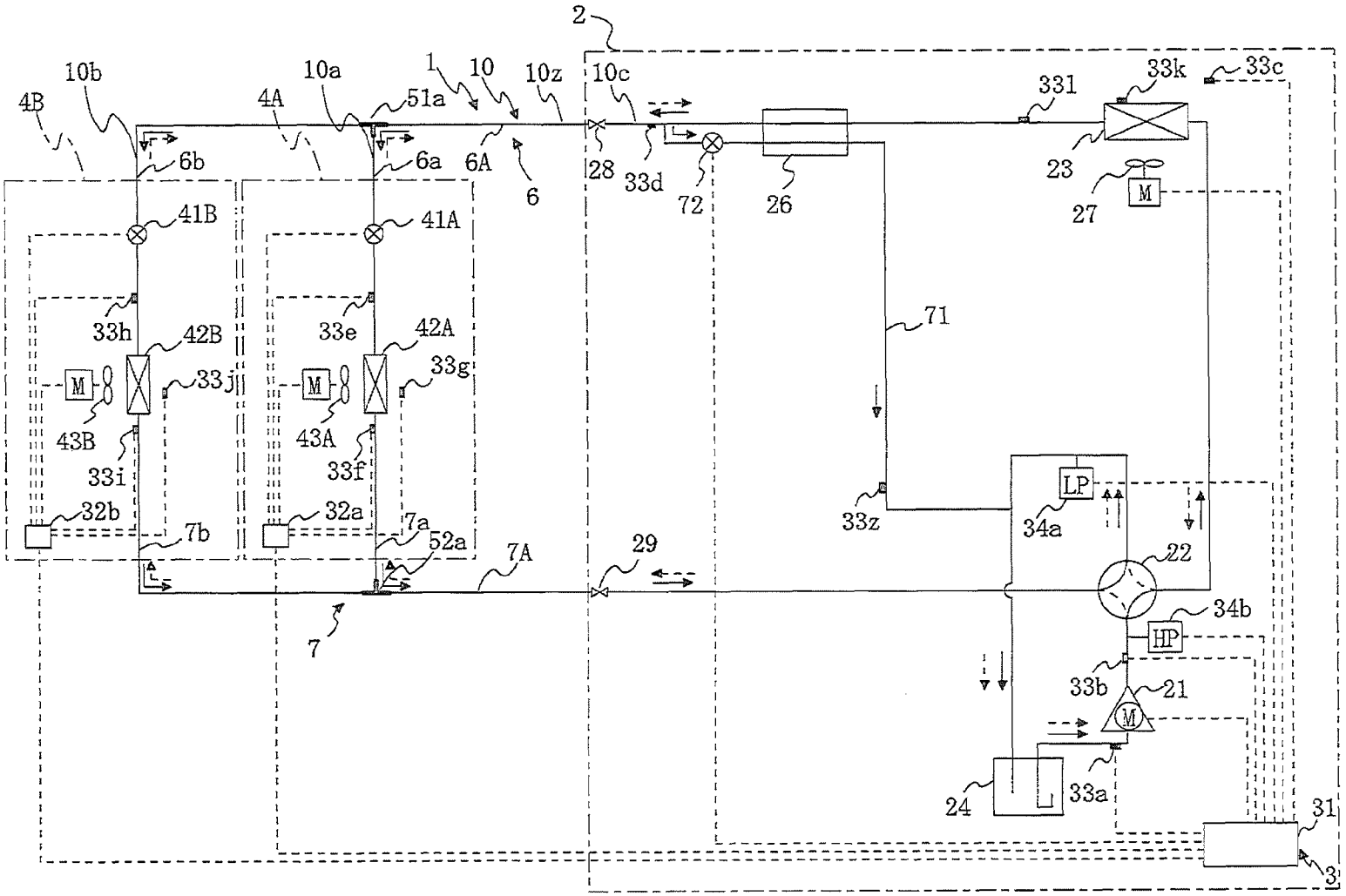
FIG. 1 is a refrigerant circuit diagram of a refrigeration and air-conditioning apparatus 1 according to Embodiment 1 of the invention.

FIG. 1 is a block diagram of the refrigeration and air-conditioning apparatus 1 according to Embodiment 1 of the invention. The refrigeration and air-conditioning apparatus 1 is an apparatus used for cooling and heating inside a room in a building and the like by execution of a vapor compression refrigeration cycle operation. The refrigeration and air-conditioning apparatus 1 mainly includes an outdoor unit 2 as a heat source unit, indoor units 4A and 4B as a plurality of (two, in Embodiment 1) use units connected in parallel, a liquid refrigerant extension piping 6, and a gas refrigerant extension piping 7. The liquid refrigerant extension piping 6 is a piping connecting the outdoor unit 2 to the indoor units 4A and 4B in which liquid refrigerant passes and is configured by connecting a liquid main pipe 6A, liquid branch pipes 6*a* and 6*b*, and a distributer 51*a*. The gas refrigerant extension piping 7 is a piping connecting the outdoor unit 2 to the indoor units 4A and 4B in which gas refrigerant passes and is configured by connecting a gas main pipe 7A, gas branch pipes 7*a* and 7*b*, and a distributer 52*a*.

(Indoor Unit)

The indoor units 4A and 4B are installed by concealing or suspending the units in or from a ceiling of a building, or by fixing the units on an indoor wall. The indoor units 4A and 4B are connected to the outdoor unit 2 with the liquid refrigerant extension piping 6 and the gas refrigerant extension piping 7, and constitute a portion of a refrigerant circuit 10.

Next, configuration of the indoor units 4A and 4B will be described. It should be noted that the indoor units 4A and 4B have the same configuration and, therefore, only the configuration of the indoor unit 4A will be described. The configuration of the indoor unit 4B corresponds to a configuration in which A in the reference numeral denoting each portion of the indoor unit 4A is replaced with B.

The indoor unit 4A mainly has an indoor side refrigerant circuit 10*a* (indoor side refrigerant circuit 10*b* in the indoor unit 4B) constituting a portion of the refrigerant circuit 10. The indoor side refrigerant circuit 10*a* mainly has an expansion valve 41A as an expansion mechanism and an indoor heat exchanger 42A as a use side heat exchanger.

In Embodiment 1, the expansion valve 41A is an electronic expansion valve connected to the liquid side of the indoor heat exchanger 42A for controlling the flow rate of the refrigerant flowing in the indoor side refrigerant circuit 10*a*.

In Embodiment 1, the indoor heat exchanger 42A is a cross-finned type fin-and-tube heat exchanger constituted by a heat transfer pipe and multiple fins and is a heat exchanger acting as an evaporator of the refrigerant to cool indoor air during cooling operation and as a condenser of the refrigerant to heat indoor air during heating operation.

In Embodiment 1, the indoor unit 4A has an indoor fan 43A acting as an blower to supply the room with supplying air after sucking indoor air into the indoor unit and exchanging heat with refrigerant in the indoor heat exchanger 42A. The indoor fan 43A is a fan capable of varying flow rate of air supplied to the indoor heat exchanger 42A and, in Embodiment 1, the indoor fan 43A is a centrifugal fan, a multiblade fan, or the like driven by a DC fan motor.

The indoor unit 4A is provided with various sensors. On the gas side of the indoor heat exchangers 42A and 42B, gas side temperature sensors 33*f* and 33*i* are disposed that detect refrigerant temperatures (i.e., refrigerant temperatures corresponding to a condensing temperature Tc during heating operation and an evaporating temperature Te during cooling operation). On the liquid side of the indoor heat exchangers 42A and 42B, liquid side temperature sensors 33*e* and 33*h* are disposed that detect a refrigerant temperature Teo. On indoor-air suction port sides of the indoor units 4A and 4B, indoor temperature sensors 33*g* and 33*j* are disposed that detect a temperature of indoor air flowing into the units (i.e., indoor temperature Tr). In Embodiment 1, each of the temperature sensors 33*e*, 33*f*, 33*g*, 33*h*, 33*i*, and 33*j* is constituted by a thermistor.

The indoor unit 4A has indoor side control unit 32*a* controlling parts of the indoor unit 4A. The indoor unit 4B has indoor side control unit 32*b* controlling parts of the indoor unit 4B. The indoor side control units 32*a* and 32*b* have microcomputers, memories, and the like disposed for controlling the indoor units 4A and 4B. The indoor side control units 32*a* and 32*b* can exchange control signals and the like with remote controllers (not depicted) for individually operating the indoor units 4A and 4B and can exchange control signals and the like via a transmission line with the outdoor unit 2.

(Outdoor Unit)

The outdoor unit 2 is installed outside a building and the like and is connected to the indoor units 4A and 4B through the liquid main pipe 6A and the liquid branch pipes 6*a* and 6*b* as well as the gas main pipe 7A and the gas branch pipes 7*a* and 7*b*, and constitutes the refrigerant circuit 10 with the indoor units 4A and 4B.

A configuration of the outdoor unit 2 will be described. The outdoor unit 2 mainly has an outdoor side refrigerant circuit 10*c* constituting a portion of the refrigerant circuit 10. The outdoor side refrigerant circuit 10*c* mainly has a compressor 21, a four-way valve 22, an outdoor heat exchanger 23, an accumulator 24, a supercooler 26, a liquid side stop valve 28, and a gas side stop valve 29.

The compressor 21 is a compressor capable of varying an operating capacity and, in Embodiment 1, is a positive-displacement compressor driven by a motor having frequency F controlled by an inverter. Although only one compressor 21 exists in Embodiment 1, this is not a limitation and two or more compressors may be connected in parallel depending on the number of connected indoor units.

The four-way valve 22 is a valve for switching directions of flow of refrigerant. The four-way valve 22 is switched as indicated by solid lines during cooling operation to connect the discharge side of the compressor 21 with the gas side of the outdoor heat exchanger 23 and connect the accumulator 24 with the gas main pipe 7A side. This causes the outdoor heat exchanger 23 to act as a condenser of the refrigerant compressed by the compressor 21 and causes the indoor heat exchangers 42A and 42B to act as evaporators. The four-way valve 22 is switched as indicated by dashed lines in the four-way valve during heating operation to connect the discharge side of the compressor 21 with the gas main pipe 7A and connect the accumulator 24 with the gas side of the outdoor heat exchanger 23. This causes the indoor heat exchangers 42A and 42B to act as condensers of the refrigerant compressed by the compressor 21 and causes the outdoor heat exchanger 23 to act as an evaporator.

In Embodiment 1, the outdoor heat exchanger 23 is a cross-finned type fin-and-tube heat exchanger constituted by a heat transfer pipe and multiple fins. As described above, the outdoor heat exchanger 23 acts as a condenser of the refrigerant during cooling operation and acts as an evaporator of the refrigerant during heating operation. The gas side of the outdoor heat exchanger 23 is connected to the four-way valve 22 and the liquid side thereof is connected to the liquid main pipe 6A.

In Embodiment 1, the outdoor unit 2 has an outdoor fan 27 acting as a blower to discharge air outdoors after sucking outdoor air into the unit and exchanging heat with the refrigerant in the outdoor heat exchanger. The outdoor fan 27 is a fan capable of varying flow rate of air supplied to the outdoor heat exchanger 23 and, in Embodiment 1, is a propeller fan or the like driven by a motor constituted by a DC fan motor.

The accumulator 24 is connected between the four-way valve 22 and the compressor 21 and is a container capable of accumulating excess refrigerant generated in the refrigerant circuit 10 in proportion to varying operating loads and the like of the indoor units 4A and 4B.

The supercooler 26 is a double-pipe heat exchanger and is provided to cool the refrigerant sent to the expansion valves 41A and 41*b* after condensation in the outdoor heat exchanger 23. The supercooler 26 is connected between the outdoor heat exchanger 23 and the liquid side stop valve 28 in Embodiment 1.

In Embodiment 1, a bypass circuit 71 is provided as a cooling source of the supercooler 26. In the following description, the refrigerant circuit 10 without the bypass circuit 71 is referred to as a main refrigerant circuit 10*z*.

The bypass circuit 71 is connected to the main refrigerant circuit 10*z* so as to branch a portion of the refrigerant sent from the outdoor heat exchanger 23 towards the expansion valves 41A and 41B and return it to the suction side of the compressor 21. Specifically, the bypass circuit 71 is connected so as to branch a portion of the refrigerant sent from the outdoor heat exchanger 23 toward the expansion valves 41A and 41B at a position between the supercooler 26 and the liquid side stop valve 28, and return the refrigerant to the suction side of the compressor 21 via a bypass flow control valve 72, constituted by an electronic expansion valve, and the supercooler 26. As a result, the refrigerant sent from the outdoor heat exchanger 23 toward the indoor expansion valves 41A and 41B is cooled by the supercooler 26 after the refrigerant flowing in the bypass circuit 71 is reduced in pressure by a bypass flow control valve 72. That is, the capacity of the supercooler 26 is controlled by adjusting the opening-degree of the bypass flow control valve 72.

The liquid side stop valve 28 and the gas side stop valve 29 are valves disposed in connection ports for external devices/piping (specifically, the liquid main pipe 6A and the gas main pipe 7A).

The outdoor unit 2 is disposed with pluralities of pressure sensors and temperature sensors. The pressure sensors disposed are a suction pressure sensor 34*a* that detects a suction pressure Ps of the compressor 21 and a discharge pressure sensor 34*b* that detects a discharge pressure Pd of the compressor 21.

The temperature sensors are constituted by thermistors and the temperature sensors disposed are a suction temperature sensor 33*a*, a discharge temperature sensor 33*b*, a heat exchange temperature sensor 33*k*, a liquid side temperature sensor 33*l*, a liquid pipe temperature sensor 33*d*, a bypass temperature sensor 33*z*, and an outdoor temperature sensor 33*c*.

The suction temperature sensor 33*a* is disposed between the accumulator 24 and the compressor 21, and detects the suction temperature Ts of the compressor 21. The discharge temperature sensor 33*b* detects the discharge temperature Td of the compressor 21. The heat exchange temperature sensor 33*k* detects a temperature of the refrigerant flowing in the outdoor heat exchanger 23. The liquid side temperature sensor 33*l* is disposed on the liquid side of the outdoor heat exchanger 23 to detect a refrigerant temperature on the liquid side of the outdoor heat exchanger 23. The liquid pipe temperature sensor 33*d* is disposed at the outlet of the supercooler 26 on the main refrigerant circuit 10*z* side, and detects a temperature of the refrigerant. The bypass temperature sensor 33*z* detects a temperature of the refrigerant flowing through the outlet of the supercooler 26 in the bypass circuit 71. The outdoor temperature sensor 33*c* is disposed on an outdoor-air suction port side of the outdoor unit 2, and detects a temperature of outdoor air flowing into the unit.

The outdoor unit 2 has an outdoor side control unit 31 that controls operations of components constituting the outdoor unit 2. The outdoor side control unit 31 has a microcomputer disposed for controlling the outdoor unit 2, a memory, an inverter circuit that controls a motor, and the like. The outdoor side control unit 31 is configured to exchange control signals and the like, via transmission lines with the indoor side control units 32*a* and 32*b* of the indoor units 4A and 4B. The outdoor side control unit 31 constitutes, along with the indoor side control units 32*a* and 32*b*, a control unit 3 that controls the operation of the whole refrigeration and air-conditioning apparatus 1.

Figure 2:
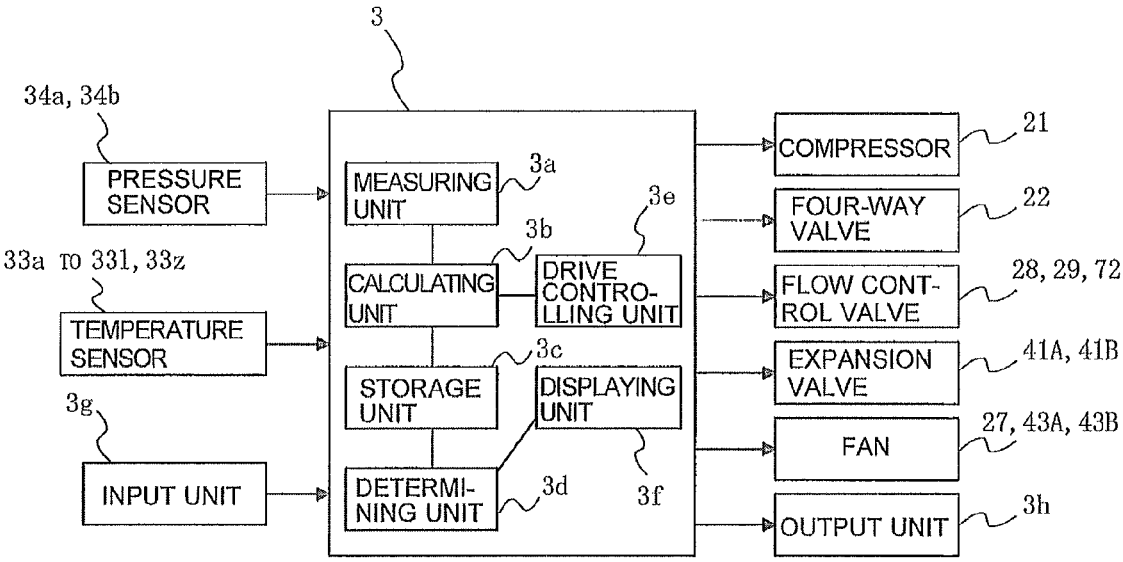
FIG. 2 is a diagram showing configuration of a control block of the refrigeration and air-conditioning apparatus 1 according to Embodiment 1 of the invention.

FIG. 2 is a control block diagram of the refrigeration and air-conditioning apparatus 1 according to Embodiment 1 of the invention. The control unit 3 is connected so as to be capable of receiving detection signals of the pressure sensors 34*a* and 34*b*, and the temperature sensors 33*a* to 33*l* and 33*z*. The control unit 3 is connected to various devices and valves so as to be capable of controlling the various devices (the compressor 21, the fan 27, the fans 43A and 43B) and the valves (the four-way valve 22, the flow control valves (the liquid side stop valve 28, the gas side stop valve 29, the bypass flow control valve 72), the expansion valves 41A and 41B) based on these detection signals.

The control unit 3 includes a measuring unit 3*a*, a calculating unit 3*b*, a storage unit 3*c*, a determining unit 3*d*, a drive controlling unit 3*e*, a displaying unit 3*f*, an input unit 3*g*, and an output unit 3*h*. The measuring unit 3*a* is a portion that measures information from the pressure sensors 34*a* and 34*b*, and the temperature sensors 33*a* to 33*l* and 33*z* and is a portion constituting a measurement unit along with the pressure sensors 34*a* and 34*b*, and the temperature sensors 33*a* to 33*l* and 33*z*. The calculating unit 3*b* is a portion calculating an inner volume of the refrigerant extension piping and calculating a reference amount of refrigerant that is a criterion for determining refrigerant leakage from the refrigerant circuit 10, based on information and the like measured by the measuring unit 3*a*. The storage unit 3*c* is a portion storing values measured by the measuring unit 3*a* and values calculated by the calculating unit 3*b*, storing inner volume data and initial charging amount described later, and storing information from the outside. The determining unit 3*d* is a portion determining the presence or absence of refrigerant leakage by comparing the reference amount of refrigerant stored in the storage unit 3*c* with a total amount of refrigerant in the refrigerant circuit 10 calculated by the operation.

The drive controlling unit 3*e* is a portion controlling a compressor motor, valves, and fan motors, which are driving components of the refrigeration and air-conditioning apparatus 1. The displaying unit 3*f* is a portion displaying and reporting information to the outside when charging of the refrigerant is completed or refrigerant leakage is detected, and displaying abnormality when the refrigeration and air-conditioning apparatus 1 is operated. The input portion 3*g* is a portion entering and changing setting values for various controls and entering external information such as a charging amount of refrigerant. The output unit 3*h* is a portion outputting measurement values measured by the measuring unit 3*a* and values calculated by the calculating unit 3*b* to the outside. The output unit 3*h* may be a communicating unit for communicating with an external apparatus and the refrigeration and air-conditioning apparatus 1 is configured to enable transmission of refrigerant leakage presence-absence data indicating a refrigerant leakage detection result through a communication line and the like, to a remote control center and the like The control unit 3 configured as above undergoes operation by switching between cooling operation and heating operation, which are normal operations, with the four-way valve 22 and controls each device of the outdoor unit 2 and the indoor units 4A and 4B depending on the operating load of each of the indoor units 4A and 4B. The control unit 3 executes a refrigerant leakage detection process described later.

(Refrigerant Extension Piping)

The refrigerant extension piping is the piping necessary for connecting the outdoor unit 2 to the indoor units 4A and 4B, and for circulating the refrigerant in the refrigeration and air-conditioning apparatus 1.

The refrigerant extension piping includes the liquid refrigerant extension piping 6 (the liquid main pipe 6A, the liquid branch pipes 6*a* and 6*b*) and the gas refrigerant extension piping 7 (the gas main pipe 7A, the gas branch pipes 7*a* and 7*b*) and is a refrigerant piping constructed on site when the refrigeration and air-conditioning apparatus 1 is installed in a installing location such as a building. A refrigerant extension piping with each pipe diameter determined in accordance with a combination of the outdoor unit 2 and the indoor units 4A and 4B is used.

Length of the refrigerant extension piping varies depending on the on-site installing conditions. As a result, inner volume of the refrigerant extension piping also varies depending on the installing site and cannot be input in advance before shipment. Therefore, an inner volume of the refrigerant extension piping should be calculated per site. Details of a calculating method of the inner volume of the refrigerant extension piping will be described later.

In Embodiment 1, the distributers 51*a* and 52*a* and the refrigerant extension piping (the liquid refrigerant extension piping 6 and the gas refrigerant extension piping 7) are used for connecting between one outdoor unit 2 and two indoor units 4A and 4B. The liquid refrigerant extension piping 6 connects the outdoor unit 2 and the distributer 51*a* through the liquid main pipe 6A and connects the distributer 51*a* and the indoor unit 4A and 4B through the liquid branch pipes 6*a* and 6*b*. The gas refrigerant extension piping 7 connects the indoor units 4A, 4B and the distributer 52*a* through the gas branch pipes 7*a* and 7*b* and connects the distributer 52*a* and the outdoor unit 2 through the gas main pipe 7A. Although T-shaped pipes are used for the distributers 51*a* and 52*a* in Embodiment 1, this is not a limitation and headers may be used. If a plurality of indoor units is connected, a plurality of T-shaped pipes may be used for distribution or a header may be used.

As described above, the refrigerant circuit 10 is constituted by connecting the indoor side refrigerant circuits 10*a* and 10*b*, the outdoor side refrigerant circuit 10*c*, and the refrigerant extension piping (the liquid refrigerant extension piping 6 and the gas refrigerant extension piping 7). The refrigeration and air-conditioning apparatus 1 includes the refrigerant circuit 10 and the bypass circuit 71. The refrigeration and air-conditioning apparatus 1 of Embodiment 1 undergoes operation by switching between cooling operation and heating operation with the four-way valve 22 and controls each devices of the outdoor unit 2 and the indoor units 4A and 4B depending on the operating load of each of the indoor units 4A and 4B, through the control unit 3 constituted by the indoor side control units 32*a* and 32*b* and the outdoor side control unit 31.

<Operation of the Refrigeration Air-Conditioning Apparatus 1>

Operations of each component during normal operation of the refrigeration and air-conditioning apparatus 1 of Embodiment 1 will be described.

The refrigeration and air-conditioning apparatus 1 of Embodiment 1 performs cooing operation or heating operation as normal operation and controls the components of the outdoor unit 2 and the indoor units 4A and 4B depending on the operating load of the indoor units 4A and 4B. Description will be made in the order of cooling operation and heating operation.

(Cooling Operation)

Figure 3:
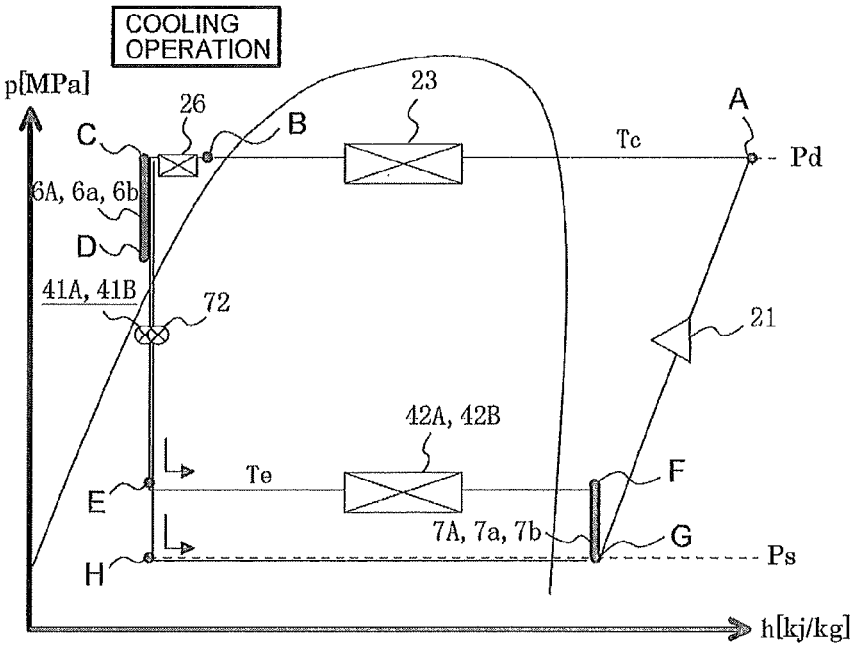
FIG. 3 is a p-h diagram during cooling operation of the refrigeration and air-conditioning apparatus 1 according to Embodiment 1 of the invention.

FIG. 3 is a p-h diagram during cooling operation of the refrigeration and air-conditioning apparatus 1 according to Embodiment 1 of the invention. The cooling operation will hereinafter be described with reference to FIGS. 3 and 1.

During cooling operation, the four-way valve 22 is in the state indicated by solid lines in FIG. 1, i.e., the discharge side of the compressor 21 is connected to the gas side of the outdoor heat exchanger 23 and the suction side of the compressor 21 is connected to the gas side of the indoor heat exchangers 42A and 42B through the gas side stop valve 29 and the gas refrigerant extension piping 7 (the gas main pipe 7A, the gas branch pipes 7*a* and 7*b*). The liquid side stop valve 28, the gas side stop valve 29, and the bypass flow control valve 72 are all opened.

Flow of the refrigerant in the main refrigerant circuit 10*z* during cooling operation will be described.

The flow of the refrigerant during cooling operation is indicated by solid line arrows in FIG. 1. High-temperature and high-pressure gas refrigerant (point "A" in FIG. 3) compressed by the compressor 21 goes through the four-way valve 22 to the outdoor heat exchanger 23 and is condensed and liquefied by the blowing action of the fan 27 (point "B" in FIG. 3). The condensing temperature at this timing is obtained by the heat exchange temperature sensor 33*k* or is obtained by converting a pressure of the discharge pressure sensor 34*b* into saturation temperature.

The refrigerant condensed and liquefied by the outdoor heat exchanger 23 further increases its supercooling degree in the supercooler 26 (point "C" in FIG. 3). The supercooling degree at the outlet of the supercooler 26 at this timing is obtained by subtracting a temperature of the liquid pipe temperature sensor 33*d* disposed on the outlet side of the supercooler 26 from the above condensing temperature.

The refrigerant subsequently passes through the liquid side stop valve 28, reduces its pressure due to pipe wall friction in the liquid main pipe 6A, the liquid branch pipes 6*a* and 6*b*, i.e., the liquid refrigerant extension piping 6 (point "D" in FIG. 3), and is sent to the use units 4A and 4B, and is reduced in pressure into a low-pressure, two-phase gas-liquid refrigerant by the expansion valves 41A and 41B (point "E" in FIG. 3). The two-phase gas-liquid refrigerant is gasified by the blowing action of the indoor fans 43A and 43B in the indoor heat exchangers 42A and 42B that are evaporators (point "F" in FIG. 3).

The evaporating temperature at this timing is measured by the liquid side temperature sensors 33*e* and 33*h*, and a superheat degree SH of the refrigerant at the outlets of the indoor heat exchangers 42A and 42B is obtained by subtracting a refrigerant temperature detected by the liquid side temperature sensors 33*e* and 33*h* from a refrigerant temperature value detected by the gas side temperature sensors 33*f* and 33*i*. Each of the expansion valves 41A and 41B has the opening-degree adjusted such that the superheat degree SH of the refrigerant at the outlets of the indoor heat exchangers 42A and 42B (i.e., on the gas side of the indoor heat exchangers 42A and 42B) becomes a superheat degree target value SHm.

The gas refrigerant passing through the indoor heat exchangers 42A and 42B (point "F" in FIG. 3) flows into the gas branch pipes 7*a* and 7*b*, and the gas main pipe 7A, i.e., the gas refrigerant extension piping 7, and is reduced in pressure due to pipe wall friction of the piping when passing through these pipes (point "G" in FIG. 3). The refrigerant passes through the gas side stop valve 29 and the accumulator 24 and returns to the compressor 21.

Next, flow of the refrigerant in the bypass circuit 71 will be described. The inlet of the bypass circuit 71 is located between the outlet of the supercooler 26 and the liquid side stop valve 28, and branches a portion of the high-pressure, liquid refrigerant cooled by the supercooler 26 (point "C" in FIG. 3). The refrigerant is reduced in pressure by the bypass flow control valve 72 into a low-pressure, two-phase refrigerant (point "H" in FIG. 3), and then flows into the supercooler 26. In the supercooler 26, the refrigerant that has passed through the bypass flow control valve 72 of the bypass circuit 71 exchanges heat with the high-pressure, liquid refrigerant in the main refrigerant circuit 10*z* and cools the high-pressure, liquid refrigerant flowing through the main refrigerant circuit 10*z*. As a result, the refrigerant flowing through the bypass circuit 71 is evaporated and gasified, and returns to the compressor 21 (point "G" in FIG. 3).

In this case, the opening degree of the bypass flow control valve 72 is adjusted such that a superheat degree SHb of the refrigerant at the outlet of the supercooler 26 on the bypass circuit 71 side becomes a superheat degree target value SHbm. In Embodiment 1, the superheat degree SHb of the refrigerant at the outlet of the supercooler 26 on the bypass circuit 71 side is detected by subtracting a converted saturation temperature value of the suction pressure Ps of the compressor 21 detected by the suction pressure sensor 34*a* from a refrigerant temperature detected by the bypass temperature sensor 33*z*. Although not employed in Embodiment 1, a temperature sensor may be disposed between the bypass flow control valve 72 and the supercooler 26 to detect the superheat degree SHb of the refrigerant at the outlet of the supercooler 26 on the bypass circuit side by subtracting a refrigerant temperature value measured by this temperature sensor from a refrigerant temperature value measured by the bypass temperature sensor 33*z*.

Although the inlet of the bypass circuit 71 is located between the outlet of the supercooler 26 and the liquid side stop valve 28 in Embodiment 1, the inlet of the bypass circuit 71 may be disposed between the outdoor heat exchanger 23 and the supercooler 26.

(Heating Operation)

Figure 4:
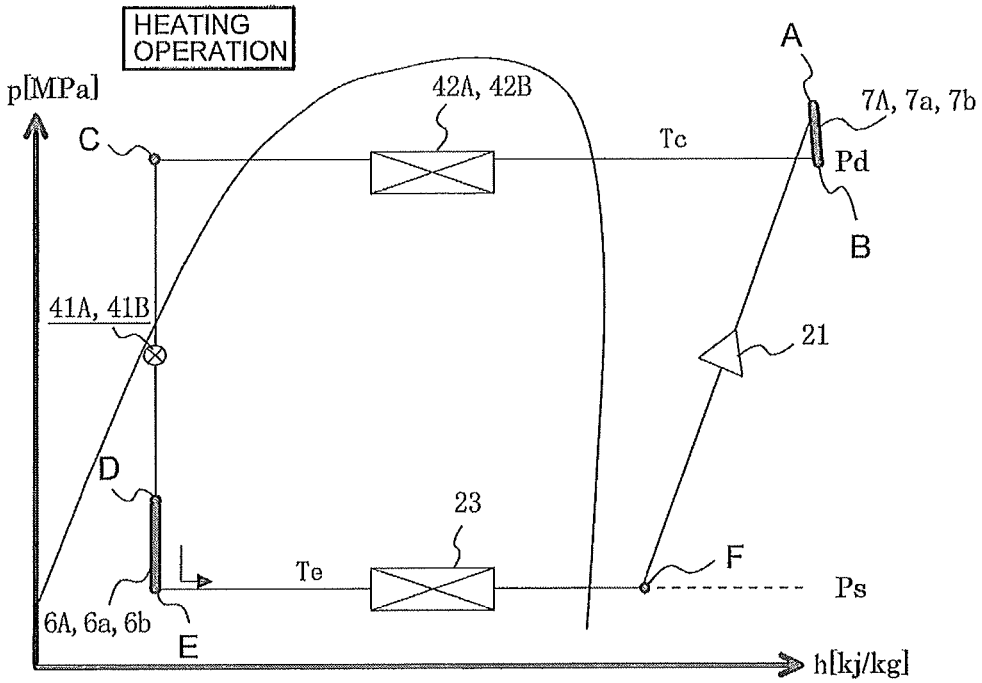
FIG. 4 is a p-h diagram during heating operation of the refrigeration and air-conditioning apparatus 1 according to Embodiment 1 of the invention.

FIG. 4 is a p-h diagram during heating operation of the refrigeration and air-conditioning apparatus 1 according to Embodiment 1 of the invention. The heating operation will hereinafter be described with reference to FIGS. 4 and 1.

During heating operation, the four-way valve 22 is in the state depicted by dashed lines in FIG. 1. That is, the discharge side of the compressor 21 is connected to the gas side of the indoor heat exchangers 42A and 42B through the gas side stop valve 29 and the gas refrigerant extension piping 7 (the gas main pipe 7A, the gas branch pipes 7*a* and 7*b*) and the suction side of the compressor 21 is connected to the gas side of the outdoor heat exchanger 23. The liquid side stop valve 28 and the gas side stop valve 29 are opened, and the bypass flow control valve 72 is closed.

Flow of the refrigerant in the main refrigerant circuit 10*z* in heating operation will be described.

The flow of the refrigerant under heating condition is indicated by dashed line arrows in FIG. 1. High-temperature and high-pressure refrigerant (point "A" in FIG. 4) compressed by the compressor 21 passes through the gas main pipe 7A, the gas branch pipes 7*a* and 7*b*, i.e., the refrigerant gas extension piping, is reduced in pressure due to pipe wall friction (point "B" in FIG. 4), and flows into the indoor heat exchangers 42A and 42B. The refrigerant is condensed and liquefied by the blowing action of the indoor fans 43A and 43B in the indoor heat exchangers 42A and 42B (point "C" in FIG. 4) and is reduced in pressure into a low-pressure, two-phase gas-liquid refrigerant by the expansion valves 41A and 41B (point "D" in FIG. 4).

The opening degrees of the expansion valves 41A and 41B are adjusted such that the supercooling degree SC of the refrigerant at the outlets of the indoor heat exchangers 42A and 42B is kept constantly at a supercooling degree target value SCm. In Embodiment 1, the supercooling degree SC of the refrigerant at the outlets of the indoor heat exchangers 42A and 42B is detected by converting the discharge pressure Pd of the compressor 21 detected by the discharge pressure sensor 34*b* into a saturation temperature value corresponding to the condensing temperature Tc and by subtracting a refrigerant temperature value detected by the liquid side temperature sensors 33*e* and 33*h* from the saturation temperature value of the refrigerant.

Although not employed in Embodiment 1, a temperature sensor detecting a temperature of the refrigerant flowing in the indoor heat exchangers 42A and 42B may be disposed, and the supercooling degree SC of the refrigerant at the outlets of the indoor heat exchangers 42A and 42B may be detected by subtracting a refrigerant temperature value corresponding to the condensing temperature Tc detected by this sensor from a refrigerant temperature value detected by the liquid side temperature sensors 33*e* and 33*h*. Subsequently, the low-pressure, two-phase gas-liquid refrigerant is reduced in pressure due to pipe wall friction in the liquid main pipe 6A, the liquid branch pipes 6*a* and 6*b*, i.e., the liquid refrigerant extension piping 6 (point "E" in FIG. 4) and passes through the liquid side stop valve 28 to the outdoor heat exchanger 23. The refrigerant is evaporated and gasified due to blowing action of the outdoor fan 27 in the outdoor heat exchanger 23 (point "F" in FIG. 4) and passes through the four-way valve 22 and the accumulator 24, returning to the compressor 21.

(Refrigerant Leakage Detection Method)

Flow of a refrigerant leakage detection method will be described. Refrigerant leakage detection is implemented at all times during operation of the refrigeration and air-conditioning apparatus 1. The refrigeration and air-conditioning apparatus 1 is configured to transmit the refrigerant leakage presence-absence data indicating a refrigerant leakage detection result through a communication line to a control center (not depicted) and to enable remote monitoring.

In Embodiment 1, by way of example, a method of calculating the total amount of refrigerant charged in an existing refrigeration and air-conditioning apparatus 1 and detecting whether the refrigerant is leaking will be described.

Figure 5:
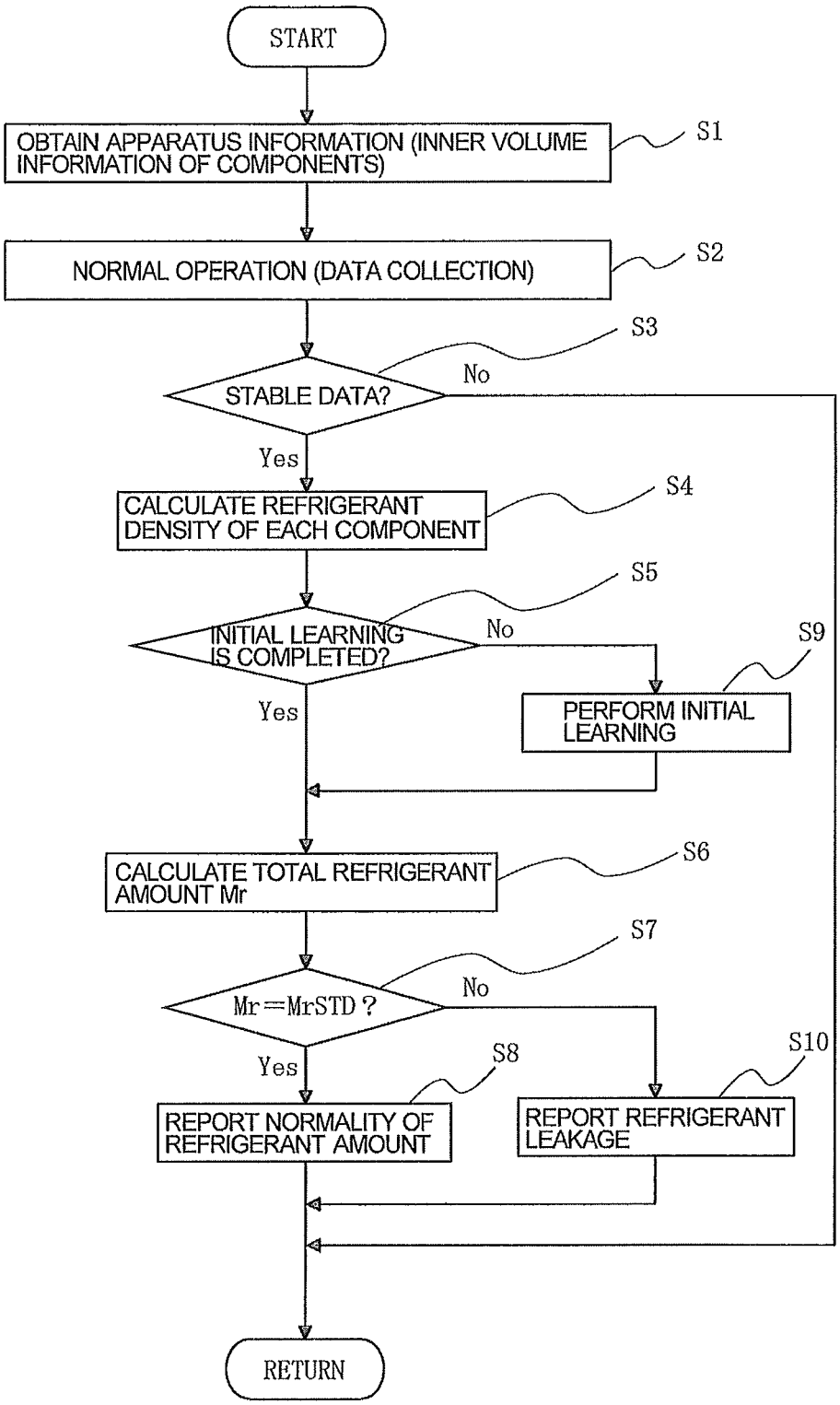
FIG. 5 is a flowchart of a refrigerant leakage detection method of the refrigeration and air-conditioning apparatus 1 according to Embodiment 1 of the invention.

The refrigerant leakage detection method will hereinafter be described with reference to FIG. 5. FIG. 5 is a flowchart showing a procedure of a refrigerant leakage detection process in the refrigeration and air-conditioning apparatus 1 according to Embodiment 1 of the invention. The refrigerant leakage detection is performed during normal cooling operation or heating operation without special operation for detecting refrigerant leakage, and the refrigerant leakage detection is performed by using a set of operation data during these operations. That is, the control unit 3 executes the process in the flowchart in FIG. 5 while performing normal operation. The set of operation data is data indicating an operation state quantity and, specifically, indicates measurement values obtained by the pressure sensors 34*a* and 34*b*, the temperature sensors 33*a* to 33*l* and 33*z*.

In obtaining apparatus information in step S1, the control unit 3 obtains from the storage unit 3*c* the inner volumes of the constituent components of the refrigerant circuit 10 other than the liquid refrigerant extension piping 6 and the gas refrigerant extension piping 7 necessary for calculating the amount of refrigerant. In other words, the control unit 3 obtains each inner volumes of pipes and devices (the compressor 21, the outdoor heat exchanger 23, and the supercooler 26) in the indoor units 4A and 4B, and inner volumes of pipes and devices (the indoor heat exchangers 42A and 42B) in the outdoor unit 2. The inner volume data necessary for calculating the amount of refrigerant other than the refrigerant extension piping in the refrigerant circuit 10 is stored in advance in the storage unit 3*c* of the control unit 3. The inner volume data may be stored into the storage unit 3*c* of the control unit 3 by a installing contractor entering the data via the input unit 3*g*, or may be obtained automatically by the control unit 3 communicating with an external control center and the like, when the outdoor unit 2 and the indoor units 4A and 4B are installed and the communication setting is set.

In step S2, the control unit 3 collects a set of current operation data (data obtained from the temperature sensors 33*a* to 33*l* and 33*z*, and the pressure sensors 34*a* and 34*b*). Since the presence or absence of refrigerant leakage is determined only from normal data necessary for operating the refrigeration and air-conditioning apparatus 1, the refrigerant leakage detection of Embodiment 1 eliminates the need for work such as adding a new sensor for the refrigerant leakage detection.

In step S3, the set of operation data collected in step S2 is checked whether it is stable data and, if the data is stable, the process goes to step S4. For example, at the time of start-up and the like, if the rotation speed of the compressor 21 fluctuates or the open-degrees of the expansion valves 41A and 41B fluctuate, the operation of the refrigerant circuit will become unstable. Therefore, it can be determined that the current operating state is not stable from the set of operation data collected in step S2, and the refrigerant leakage detection is not performed in this case.

In step S4, the stable data (set of operation data) obtained in step S3 is used for calculating density of the refrigerant in the refrigerant circuit 10 other than the liquid refrigerant extension piping 6 and the gas refrigerant extension piping 7. The density data of the refrigerant is necessary for calculating the amount of refrigerant and therefore is obtained in step 4. The density of the refrigerant passing through the constituent components of the refrigerant circuit 10 other than the liquid refrigerant extension piping 6 and the gas refrigerant extension piping 7 can be calculated with conventionally known methods. In other words, the density of the refrigerant in portions where the refrigerant is in single-phase, such as gas or liquid, can be calculated from the pressure and temperature. For example, the refrigerant is in a gas state from the compressor 21 to the outdoor heat exchanger 23 and the density of the gas refrigerant in this portion can be calculated from a discharge pressure detected by the discharge pressure sensor 34*b* and a discharge temperature detected by the discharge temperature sensor 33*b*.

The density of the refrigerant in portions where the refrigerant is in two-phase and where the state of the refrigerant changes, such as in a two-phase portion of the heat exchanger, approximate expressions are used for calculating the average density value of the two-phases from device inlet/outlet state quantities. Approximate expressions and the like, necessary for these calculations are stored in advance in the storage unit 3*c* and the control unit 3 uses the set of operation data obtained in step S3 and data such as approximate expressions stored in advance in the storage unit 3*c* to calculates respective refrigerant densities of the constituent components of the refrigerant circuit 10 other than the liquid refrigerant extension piping 6 and the gas refrigerant extension piping 7.

Next, in step S5, whether initial learning has been performed of not is checked. The initial learning is a process of calculating the inner volume of the liquid refrigerant extension piping 6 and the inner volume of the gas refrigerant extension piping 7 and calculating the reference amount of refrigerant necessary for detecting the presence or absence of refrigerant leakage. Although the inner volumes of the constituent components of the indoor units and the outdoor unit are determined and known for each type of device, the refrigerant extension piping has different piping length depending on on-site installing conditions as described above and, therefore, the inner volume of the refrigerant extension piping cannot be set in advance in the storage unit 3*c* as known data. This example is directed to the existing refrigeration and air-conditioning apparatus 1 and the inner volume of the refrigerant extension piping is not known in this regard. Therefore, in the initial learning, the refrigeration and air-conditioning apparatus is actually operated after installation to calculate the inner volume of the refrigerant extension piping by using the set of operation data during the operation. Once calculated in the initial learning, the inner volume of the refrigerant extension piping (the liquid refrigerant extension piping 6 and the gas refrigerant extension piping 7) will be repeatedly used in subsequent refrigerant leakage detections. Details of the initial learning will be described later. If the initial learning is determined to have been performed in step S5, the process goes to step S6, and if the initial learning is not performed, the process goes to step S9 to perform the initial learning.

In step S6, amount of refrigerant in the constituent components of the refrigerant circuit 10 are calculated and summed up to calculate the total amount of refrigerant Mr charged into the refrigeration and air-conditioning apparatus 1. Amount of refrigerant can be obtained by multiplying refrigerant density by inner volume. Therefore, when calculating the total amount of refrigerant Mr, the amount of refrigerant in the refrigerant circuit 10 other than the refrigerant extension piping (the liquid refrigerant extension piping 6 and the gas refrigerant extension piping 7) can be calculated based on the densities of refrigerant passing through each portions and the inner volume data stored in the storage unit 3*c*.

The amount of refrigerant in the refrigerant extension piping (the liquid refrigerant extension piping 6 and the gas refrigerant extension piping 7) is calculated by using an inner volume VPL of the liquid refrigerant extension piping 6 calculated in the initial learning and an inner volume VPG of the gas refrigerant extension piping 7 calculated in the initial learning. Therefore, the amount of refrigerant in the liquid refrigerant extension piping 6 is obtained by multiplying the inner volume VPL of the liquid refrigerant extension piping 6 by the density of liquid refrigerant flowing through the liquid refrigerant extension piping 6. The density of liquid refrigerant flowing through the liquid refrigerant extension piping 6 is obtained from a condensing pressure (obtained by converting the condensing temperature Tc obtained by the heat exchange temperature sensor 33*k*) and an outlet temperature of the supercooler 26 obtained by the liquid pipe temperature sensor 33*d*.

The amount of refrigerant in the gas refrigerant extension piping 7 is obtained by multiplying the inner volume VPG of the gas refrigerant extension piping 7 by the density of gas refrigerant flowing through the gas refrigerant extension piping 7. The density of gas refrigerant flowing through the gas refrigerant extension piping 7 is obtained from an average of the refrigerant density on the suction side of the compressor 21 and the outlet refrigerant density of the indoor heat exchangers 42A and 42B. The refrigerant density on the suction side of the compressor 21 is obtained from the suction pressure Ps and the suction temperature Ts. The outlet refrigerant density of the indoor heat exchangers 42A and 42B is obtained from an evaporating pressure Pe that is a converted value of the evaporating temperature Te, and outlet temperature of the indoor heat exchangers 42A and 42B.

The total amount of refrigerant Mr in the refrigerant circuit 10 is calculated by summing up the amount of refrigerant in the liquid refrigerant extension piping 6, the amount of refrigerant in the gas refrigerant extension piping 7, and an amount of refrigerant MA of the refrigerant circuit 10 other than the refrigerant extension piping obtained as described above.

In step S6, an amount of refrigerant in the accumulator 24 is calculated by using saturation density of the gas refrigerant on the assumption that the refrigerant in the accumulator 24 is completely gaseous.

In step S7, a reference amount of refrigerant (initial charging amount) MrSTD obtained by the initial learning described later is compared with the total amount of refrigerant Mr calculated in step S6. If MrSTD=Mr, it is determined that no refrigerant leakage exists and that refrigerant leakage exists if MrSTD>Mr. When it is determined that no refrigerant leakage exists, it is reported in step S8 that the amount of refrigerant is normal. When it is determined that refrigerant leakage exists, it is reported in step S10 that refrigerant leakage exists. The reports in steps S8 and S10 are made, for example, by displaying on the displaying unit 3*f* or by transmitting (reporting) the refrigerant leakage presence-absence data indicating the refrigerant leakage detection result through a communication line and the like to a remote control center. Although it is determined that refrigerant leakage exists if the total amount of refrigerant Mr is not equal to the initial charging amount MrSTD, a value of the total amount of refrigerant Mr may vary due to a sensor error and the like, at the time of calculation of amount of refrigerant and, therefore, a determination threshold value for the presence or absence of the refrigerant leakage may be determined in consideration of this point.

After reporting normality or abnormality, the control unit 3 goes to RETURN and repeats the process again from step S1 By repeating the process from step S1 to step S10, the refrigerant leakage detection is performed at all times during normal operation.

(Step S9: Initial Learning)

Figure 6:
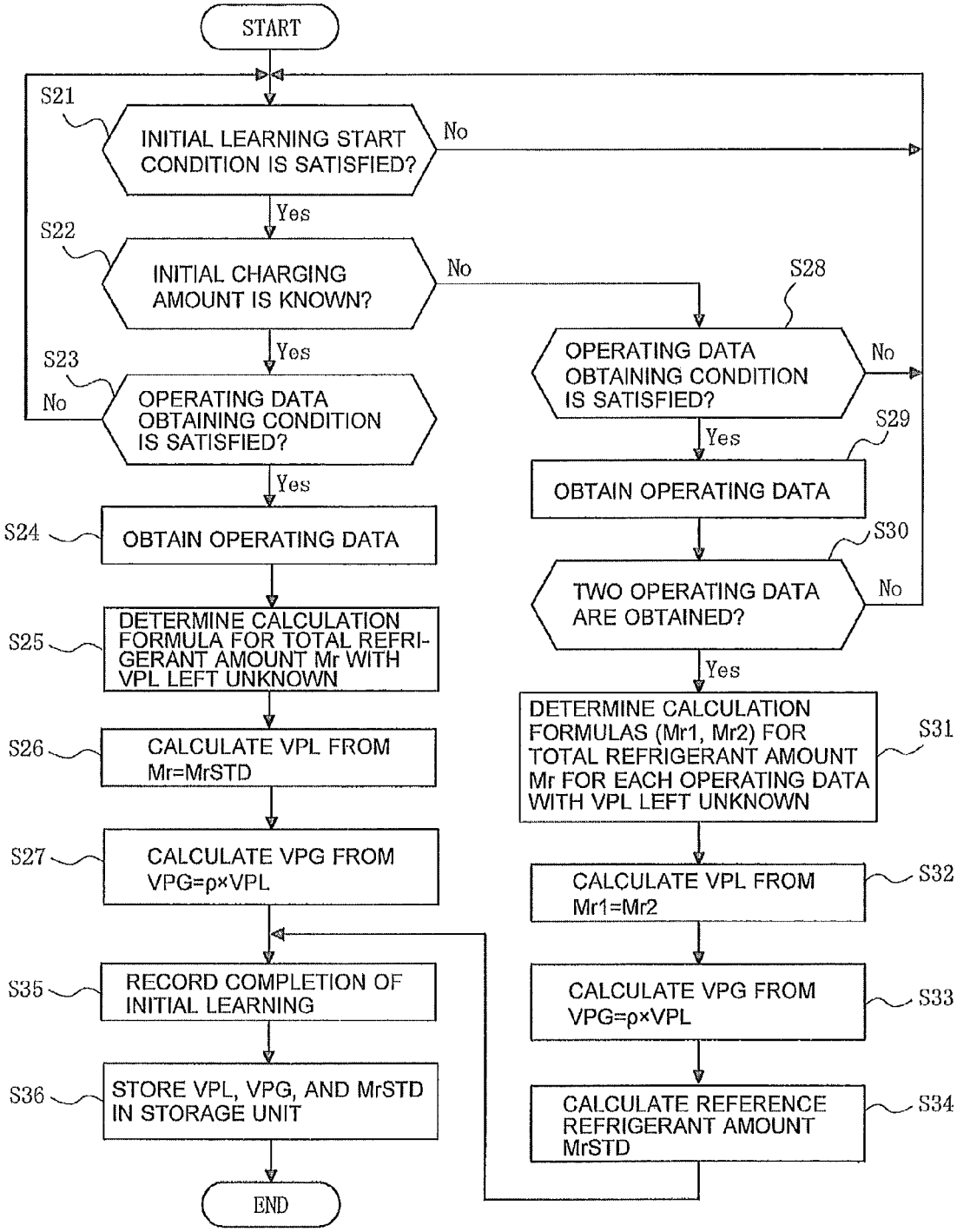
FIG. 6 is a flowchart of initial learning of the refrigeration and air-conditioning apparatus 1 according to Embodiment 1 of the invention.

FIG. 6 is a flowchart of the initial learning of the refrigeration and air-conditioning apparatus 1 according to Embodiment 1 of the invention. The initial learning will hereinafter be described with reference to FIG. 6. In the initial learning, two operations are performed that are calculation of inner volume of the refrigerant extension piping and calculation of the reference amount of refrigerant. The reference amount of refrigerant MrSTD is a reference amount that is a criterion for determining the presence or absence of refrigerant leakage when the refrigerant leakage detection is performed. Since refrigerant have more tendency to leak over time, the reference amount of refrigerant MrSTD should be calculated immediately after installation of the refrigeration and air-conditioning apparatus 1 as soon as possible. It is assumed that cooling operation is performed in this description.

In step S21, the refrigeration and air-conditioning apparatus 1 is undergoing cooling operation and checks whether the current operating state satisfies an initial learning start condition. The initial learning start condition is, in a manner of speaking, a condition determining whether the current operating state is a state that enables accurate calculation of the total amount of refrigerant. For example, the following condition is set. The amount of refrigerant in the accumulator 24 is calculated by using the density of saturation gas on the assumption that the refrigerant in the accumulator 24 is completely gaseous. Therefore, if excess liquid refrigerant has accumulated in the accumulator 24, the amount of refrigerant will be calculated as gas refrigerant in spite of the accumulated liquid refrigerant and an accurate amount of refrigerant cannot be calculated. As a result, a value calculated as the amount of refrigerant in the accumulator 24 is actually smaller by the excess amount of liquid refrigerant, and the reference amount of refrigerant MrSTD cannot be accurately calculated in step S34 described later affected by this erroneous calculation. Therefore, the initial learning is not performed when excess liquid refrigerant has accumulated in the accumulator 24 as described above. In other words, the absence of accumulation of refrigerant in the accumulator 24 is specified as the initial learning start condition.

Whether refrigerant has accumulated in the accumulator 24 can be determined by whether the superheat degree SH of the refrigerant at the outlets of the indoor heat exchangers 42A and 42B (superheat degree at the inlet of the compressor 21), based on the set of current operation data, is equal to or greater than zero. Therefore, if the superheat degree SH is equal to or greater than zero, it is determined that no refrigerant has accumulated in the accumulator 24 and, if the superheat degree SH is less than zero, it is determined that refrigerant has accumulated in the accumulator 24.

Whether the initial learning start condition is satisfied is determined as described above and, when the operating state becomes a state satisfying the initial learning condition, the process goes to step S22.

In step S22, it is checked whether an amount of refrigerant initially charged at the time of installation of the refrigeration and air-conditioning apparatus 1 is known (entered) or not. If the initial charging amount is known, for example, when the refrigeration and air-conditioning apparatus 1 is newly installed or when a record of the initial charging amount remains in the storage unit 3*c*, the process goes to step S23. If the initial charging amount is not known, for example, when no record of the initial charging amount remains in the existing refrigeration and air-conditioning apparatus 1, the process goes to step S28. If the initial charging amount is known, the value is used for determination of the presence or absence of refrigerant leakage by using the value as the reference amount of refrigerant MrSTD for determining the presence or absence of refrigerant leakage.

The steps S23 to S27 describe a procedure when the initial charging amount is known.

(When Initial Charging Amount is Known)

In step S23, it is determined whether the current operating state satisfies a preset operation data obtaining condition. While the current operating state does not satisfy the operation data obtaining condition, the process goes back to step S21 and repeats the determination steps S21, S22, and S28 until the operating state satisfies the operation data obtaining condition. Embodiment 1 is characterized in that the inner volume of the refrigerant extension piping (the liquid refrigerant extension piping 6 and the gas refrigerant extension piping 7) can be calculated from the set of operation data obtained during normal operation without using a special operation mode, and the set of operation data at the time of the operating state satisfying a predetermined operation data obtaining condition is used as the set of operation data used for calculating the inner volume of the refrigerant extension piping. It should be noted that although specification of the operation data obtaining condition when the initial charging amount is known may be the same as the initial learning start condition of step S21 or may be other conditions, in any case, an operating state enabling accurate calculation of the inner volume of the refrigerant extension piping is specified.

In step S24, when the current operating state becomes the operating state that satisfies the operation data obtaining condition, the set of operation data at the time is automatically obtained and retained as the set of operation data for initial learning.

In step S25, since the inner volume VPL of the liquid refrigerant extension piping 8 is unknown, a calculation formula for the total amount of refrigerant Mr is determined with the inner volume VPL left unknown. The inner volume VPG of the gas refrigerant extension piping 7 is calculated by using the liquid refrigerant extension piping inner volume VPL in the following expression (1).

$$VPG=\alpha\times VPL \quad (1)$$

The density of the gas refrigerant in the gas refrigerant extension piping 7 is several dozen times lower than the liquid refrigerant density of the liquid refrigerant extension piping 6, and the inner volume VPG of the gas refrigerant extension piping 7 has a smaller effect on the calculation of the total amount of refrigerant Mr than the inner volume VPL of the liquid refrigerant extension piping 6. Therefore, instead of individually calculating the inner volume VPG of the gas refrigerant extension piping 7 and the inner volume VPL of the liquid refrigerant extension piping 6, the inner volume VPG of the gas refrigerant extension piping 7 is calculated in a simplified manner using the following equation (1) with the inner volume VPL of the liquid refrigerant extension piping 6, in which only the difference in the piping diameters is considered. A volume ratio α is stored in advance in the storage unit 3*c* of the control unit 3.

In steps S25 and S26, as described above, a calculation formula for the total amount of refrigerant Mr is determined by using the set of operation data for initial learning obtained in step S24 with the inner volume VPL of the liquid refrigerant extension piping 6 left unknown, and the inner volume VPL of the liquid refrigerant extension piping 6 is calculated by using the fact that the total amount of refrigerant Mr obtained from this calculation formula is equal to the initial charging amount MrSTD. The calculation of the total amount of refrigerant Mr is the same as the total amount of refrigerant calculating method of step S6 described above.

$$\begin{aligned} Mr &= VPL\times\rho L+(\alpha\times VPL)\times\rho G+MA \\ &= MrSTD \end{aligned}$$

Therefore, the inner volume VPL of the liquid refrigerant extension piping 6 can be calculated as follows:

$$VPL=(MrSTD-MA)/(\rho L+\alpha\times\rho G)$$

in which ρL=refrigerant density in the liquid refrigerant extension piping 6, α=volume ratio of the liquid refrigerant extension piping 6 and the gas refrigerant extension piping 7, ρG=refrigerant density in the gas refrigerant extension piping 7, and MA=amount of refrigerant in the refrigerant circuit 10 other than the refrigerant extension piping.

The calculation formula for the total amount of refrigerant Mr consists of known values calculable from the set of operation data except for the inner volume VPL and the volume ratio α.

In step S26, the inner volume VPG of the gas refrigerant extension piping 7 is determined from the inner volume VPL of the liquid refrigerant extension piping 6 obtained in step S25 and by the expression (1).

As described above, if the initial charging amount is known, the inner volume of the refrigerant extension piping can be calculated with a single operation.

(When Initial Charging Amount is Unknown)

Next, the process of the initial learning when the initial charging amount is unknown will be described with reference to steps S28 to S34.

In step S28, the current operating state is determined whether it satisfies a preset operation data obtaining condition. This operation data obtaining condition is specified as an operating state that at least satisfies the initial learning start condition described above. Although the refrigerant extension piping inner volume can be calculated from one set of operation data when the initial charging amount is known as described above, when the initial charging amount is unknown, the refrigerant extension piping inner volume cannot be calculated unless a plurality set of (two or more) operation data is obtained. Therefore, respective operation data obtaining conditions are set in accordance with the number of the set of operation data obtained. In the following description, it is assumed that two sets of operation data are obtained.

As for the operation data obtaining condition, it is preferable that operation states that have large differences are specified, especially states that have large differences in the densities of the refrigerant in the liquid refrigerant extension piping 6. For example, corresponding to the above will be such cases when the refrigerant temperature of the liquid refrigerant extension piping 6 is at 20 degrees C. and when the refrigerant temperature of the liquid refrigerant extension piping 6 is at 10 degrees C. This is because if operating states are similar, a value difference between the operating states becomes small and, as a result, the calculation of the inner volume of the refrigerant extension piping will be largely affected by the error of measurement.

By obtaining two sets of operation data having different operating states during normal operation, as described above, and by using the operation data, as described later, the inner volume of the refrigerant extension piping is calculated. As stated above, as for the operation data obtaining condition, it is preferable that operation states that have large differences are specified. Operation states that have large differences, specifically, are states such as a state in which both indoor units 4A and 4B are in operation and a state when one of the indoor units, 4A, is stopped.

The flowchart in FIG. 6 will be described again. In step S28, the current operating state is checked whether it satisfies a preset operation data obtaining condition. In this example, the refrigerant temperature of the liquid refrigerant extension piping 6 is checked whether it is 20 degrees C. or 10 degrees C., from the outlet temperature of the supercooler 26 obtained by the liquid pipe temperature sensor 33*d*. In step S29, if the refrigerant temperature of the liquid refrigerant extension piping 6 is either 20 degrees C. or 10 degrees C., the control unit 3 automatically obtains and retains the set of operation data at the time as the set of operation data for initial learning.

In step S30, it is determined whether two sets of operation data satisfying the operation data obtaining conditions are obtained. If two sets of operation data satisfying the operation data obtaining conditions are not obtained, the process goes back to step S21 and repeats the determination in steps S21, S22, and S28 until two sets of operation data satisfying the operation data obtaining conditions are obtained. In contrast, if two sets of operation data satisfying the operation data obtaining conditions are obtained, the process goes to the next step, S31.

In step S31, a calculation formula for the total amount of refrigerant Mr is determined for each of the two sets of operation data obtained in step S29. Since the inner volume VPL of the liquid refrigerant extension piping 6 is unknown, a calculation formula for the total amount of refrigerant Mr is determined for each set of the operation data with the inner volume VPL left unknown. When Mr1 denotes a total amount of refrigerant Mr obtained from the first set of operation data 1 and Mr2 denotes a total amount of refrigerant Mr obtained from the second set of operation data 2, the respective calculation formulas are as follows:

$$Mr1=VPL\times\rho L1+(\alpha\times VPL)\times\rho G1+MA1$$

$$Mr2=VPL\times\rho L2+(\alpha\times VPL)\times\rho G2+MA2$$

in which ρL1=refrigerant density of the liquid refrigerant extension piping 6 obtained from the set of operation data 1, ρG1=refrigerant density of the gas refrigerant extension piping 7 obtained from the set of operation data 1, MA1=amount of refrigerant in the portion of the refrigerant circuit 10 other than the refrigerant extension piping obtained from the set of operation data 1, ρL2=refrigerant density of the liquid refrigerant extension piping 6 obtained from the set of operation data 2, ρG2=refrigerant density of the gas refrigerant extension piping 7 obtained from the set of operation data 2, MA2=amount of refrigerant in the refrigerant circuit 10 other than the refrigerant extension piping obtained from the set of operation data 2, and α=volume ratio of the liquid refrigerant extension piping 6 and the gas refrigerant extension piping 7.

The calculation formulas for Mr1 and Mr2 consist of known values calculable from the sets of operation data 1 and 2 except for VPL.

In step S32, since the originally charged amounts of refrigerant is equal, the following equation is created by using the fact that the above Mr1 and Mr2 are equal, and the equation is solved to calculate the inner volume VPL of the liquid refrigerant extension piping 6.

$$Mr1=Mr2$$

$$VPL\times\rho L1+(\alpha\times VPL)\times\rho G1+MA1=VPL\times\rho L2+(\alpha\times VPL)\times\rho G2+MA2$$

Therefore, the inner volume VPL of the liquid refrigerant extension piping 6 can be calculated as follows.

$$VPL=(MA2-MA1)/(\rho L1-\rho L2+\alpha(\rho G1-\rho G2))$$

As described above, even if the initial charging amount is unknown, the liquid refrigerant extension piping inner volume VPL can be calculated from at least two sets of operation data.

In step S33, the inner volume VPG of the gas refrigerant extension piping 7 is calculated from the inner volume VPL of the liquid refrigerant extension piping 6 obtained in step S32 and from the above mentioned equation (1).

In step S34, the inner volume VPL of the liquid refrigerant extension piping 6 calculated in steps S32 and S33 is substituted in the calculation formula of Mr1 described above to calculate the total amount of refrigerant Mr1, and this total amount of refrigerant Mr1 is defined as the reference amount of refrigerant MrSTD.

The process when the initial charging amount is unknown is completed by steps S28 to S38 described above.

The process described above can determine the inner volume VPL of the liquid refrigerant extension piping 6, the inner volume VPG of the gas refrigerant extension piping 7, and the reference amount of refrigerant (when the initial charging amount is known, the initial charging amount) MrSTD in both cases when the initial charging amount is known and when the initial charging amount is unknown. Finally, in step S35, the completion of the initial learning is recorded in the storage unit 3*c*. In step S36, the inner volume VPL of the liquid refrigerant extension piping 6, the inner volume VPG of the gas refrigerant extension piping 7, and the reference amount of refrigerant (when the initial charging amount is unknown, the initial charging amount) MrSTD calculated in the process are stored in the storage unit 3*c* and the initial learning is ended.

As described above, in embodiment 1, when the operating state satisfying the operation data obtaining condition is satisfied during normal operation, the set of operation data at the time is automatically obtained, and the set of operation data is used for calculating the inner volume of the refrigerant extension piping. Therefore, the inner volume of the refrigerant extension piping can be calculated by using the set of operation data during normal operation without performing special operation for calculating the inner volume of the refrigerant extension piping. Since the calculation of the inner volume of the refrigerant extension piping, and the refrigerant leakage detection are automatically performed by merely starting normal operation, conventionally required additional work such as performing special operation is not necessary.

Even if the refrigeration and air-conditioning apparatus 1 is an existing apparatus and the inner volume of the refrigerant extension piping is unknown, by performing the initial learning, the inner volume of the refrigerant extension piping and the amount of refrigerant in the refrigerant extension piping can be easily calculated based on the set of operation data during normal operation. Therefore, when calculating the inner volume of the refrigerant extension piping and determining the presence or absence of refrigerant leakage, work such as entering information of the refrigerant extension piping can be reduced to as little as possible.

When the initial learning is performed, determination is made whether the initial learning start condition and the operation data obtaining condition are satisfied. In other words, the inner volume of the refrigerant extension piping is calculated based on the set of operation data at the time of an operating state when no excess liquid refrigerant is accumulated in the accumulator 24. Therefore, the inner volume of the refrigerant extension piping and the reference amount of refrigerant can accurately be calculated. Therefore, the amount of refrigerant in the refrigerant extension piping can be calculated with high accurately, and thus, the calculation of the total amount of refrigerant and the refrigerant leakage detection in the refrigeration and air-conditioning apparatus can be accurately performed. As a result, refrigerant leakage can be promptly detected to prevent damage not only to the natural environment but also to the refrigeration and air-conditioning apparatus itself.

It has been made to specify a plurality of states that has different refrigerant density in the refrigerant piping 6 as the operation data obtaining condition when the initial charging amount is unknown in the initial learning. It will be more preferable if a plurality of states having a large difference in refrigerant density of the liquid refrigerant extension piping 6 is specified. By using a plurality set of operation data having a large difference in their operating state as such to calculate the refrigerant extension piping inner volume, the refrigerant extension piping inner volume can be calculated with high accurately with smaller effect of the error of measurement and can improve credibility of the calculation result, compared to using a plurality set of operation data of similar operating states to calculate the refrigerant extension piping inner volume.

When the refrigerant extension piping inner volume is calculated, since the inner volume of the gas refrigerant extension piping 7 is obtained from a function of the inner volume VPL of the liquid refrigerant extension piping 6, the number of obtaining operations necessary for calculation of the gas refrigerant extension piping 7 can be reduced. Therefore, for example, if the initial charging amount is known, the inner volumes VPL and VPG of the refrigerant extension piping can be calculated by obtaining the set of operation data once.

Although the inner volume of the refrigerant extension piping is calculated from one set of operation data when the initial charging amount is known in Embodiment 1, this is not a limitation. For example, the number of obtained set of operation data may be increased and a refrigerant extension piping inner volume for each operation data may be calculated, in which an average value of the calculated values may be defined as the refrigerant extension piping inner volume. This enables improvement in the credibility of the calculation result of the refrigerant extension piping inner volume, and thus, the credibility of the refrigerant leakage detection result.

However, when using a plurality set of operation data to calculate the average value of the refrigerant extension piping inner volume as such, if a set of operation data during occurrence of refrigerant leakage is used, it will not lead to improvement in credibility even if a plurality set of data is used. Therefore, the refrigerant extension piping inner volume may be temporarily calculated using each set of operation data, and the average value may be calculated using data with large calculation result values only. In the determination of whether the calculation result value is large or small, for example, the calculation results of the refrigerant extension piping inner volume may be checked in chronological order and, if a value decreases from the previous value by a predetermined value or more, it is determined that subsequent calculation results are smaller.

Although an example of performing the initial learning during cooling operation is described in Embodiment 1, this is not a limitation and the initial learning may be performed during heating operation. However, low compressor operating capacity or low outdoor temperature during heating operation leads to accumulation of liquid refrigerant in a refrigerant tank such as the accumulator 24, easily causing an error when the inner volume of the refrigerant extension piping is calculated. Therefore, for the calculation formula for the total amount of refrigerant Mr in steps S25 and S31 in FIG. 6 to be accurate and for the accurate calculation of the ultimately obtained refrigerant extension piping inner volume, a state without accumulation of liquid refrigerant in a refrigerant tank such as the accumulator 24 is specified as an initial learning start condition. Specifically as stated above, the superheat degree SH of refrigerant at the outlets of the indoor heat exchangers 42A and 42B (superheat degree at the inlet of the compressor 21) may be specified to be equal to or greater than zero, for example, or the following operating states may be specified. For example, corresponding states will be an operating capacity of a compressor being equal to or greater than a predetermined value (e.g., 50%), an outdoor temperature being equal to or greater than a predetermined temperature (e.g., 0 degrees C.), or, furthermore, combination of both, that is, the operating capacity of the compressor being equal to or greater than the predetermined value and the outdoor temperature being equal to or greater than the predetermined temperature.

Although the refrigerant leakage detection after the initial learning may be performed not only during cooling operation but also during heating operation as is the case with the initial learning, the refrigerant leakage detection should be performed in an operating state without accumulation of liquid refrigerant in a refrigerant tank such as the accumulator 24 with the same reason as described above. That is, if liquid refrigerant has accumulated in the accumulator 24, as described above, a value calculated as the amount of refrigerant in the accumulator 24 will be smaller than the actual value by the excess amount of liquid refrigerant, and the presence or absence of refrigerant leakage may be falsely detected effected by this incorrect calculation. Therefore, the refrigerant leakage detection is not performed while excess liquid refrigerant is accumulated in the accumulator 24. This enables highly accurate refrigerant leakage detection.

A set of operation data may be measured for each cooling and heating operation and the refrigerant extension piping inner volume may be calculated by using the set of operation data.

The initial learning enables calculation of the refrigerant extension piping inner volume with normal operation data while reducing, to the extent possible, work such as entering information such as length of the refrigerant extension piping. Remote monitoring is possible at all times by transmitting the refrigerant leakage presence-absence data from the output unit 3*h* through a communication line to a control center and the like Therefore, sudden leakage can immediately be attended to before resulting in abnormality such as damage to devices and capacity deterioration, and further refrigerant leakage can be prevented to be small as possible. Since this leads to improvement in reliability of the refrigeration and air-conditioning apparatus 1, deterioration of environmental conditions due to outflow of refrigerant can be prevented to the extent possible, and unfavorable operation such as forced continuous operation with small amount of refrigerant due to the refrigerant leakage can be prevented. Accordingly, the life of the refrigeration and air-conditioning apparatus 1 can be extended.

Even when there are two or more indoor units, additional relational expressions can be created by adding the use side units performing cooling operation one-by-one and calculate unknown branch pipe lengths. Since lengths of a main pipe and branch pipes can be accurately calculated in this way, by multiplying known piping inner diameters by refrigerant extension piping length, accurate refrigerant extension piping inner volume can be calculated. The amount of refrigerant in the refrigeration and air-conditioning apparatus 1 can be accurately calculated by multiplying the inner volume by respective refrigerant densities of components calculated from the operating state quantities.

Embodiment 2

In Embodiment 1 described above, the gas refrigerant extension piping inner volume VPG is calculated in a simplified manner as a function of the liquid refrigerant extension piping inner volume VPL. In Embodiment 2, respective inner volumes of a gas refrigerant extension piping 7 and a liquid refrigerant extension piping 6 are separately calculated. In this case, at least three sets of operation data are necessary for calculation of the respective inner volumes.

In Embodiment 2, a process of initial learning of a control unit 3 is different from that of the refrigeration and air-conditioning apparatus 1 of Embodiment 1 and others such as. refrigerant circuits and configuration of the control block of a refrigeration and air-conditioning apparatus 1 are the same as Embodiment 1. Process of the refrigerant leakage detection process other than the initial learning is the same as Embodiment 1.

A process of initial learning in the refrigeration and air-conditioning apparatus 1 of Embodiment 2 will hereinafter be described.

A summary of the initial learning of Embodiment 2 will be described. In the initial learning of Embodiment 1, the gas refrigerant extension piping inner volume VPG is a function of the liquid refrigerant extension piping inner volume VPL and, therefore, only the liquid refrigerant extension piping inner volume VPL is unknown. On the other hand, in Embodiment 2, both liquid refrigerant extension piping inner volume VPL and gas refrigerant extension piping inner volume VPG are unknown. Two equations are required for clarifying two unknowns. Therefore, at least three operation data obtaining conditions are set to obtain sets of operation data in operating states that satisfy each of the operation data obtaining conditions, and calculation formulas for total amount of refrigerant Mr1, Mr2, and Mr3 in a refrigerant circuit 10 are determined for each of the three sets of operation data. Since originally charged amounts of refrigerant is equal, two equations are created by using the fact that each total amount of refrigerant Mr1, Mr2, and Mr3 are equal, thereby clarifying the two unknowns (the liquid refrigerant extension piping inner volume VPL and the gas refrigerant extension piping inner volume VPG).

Figure 7:
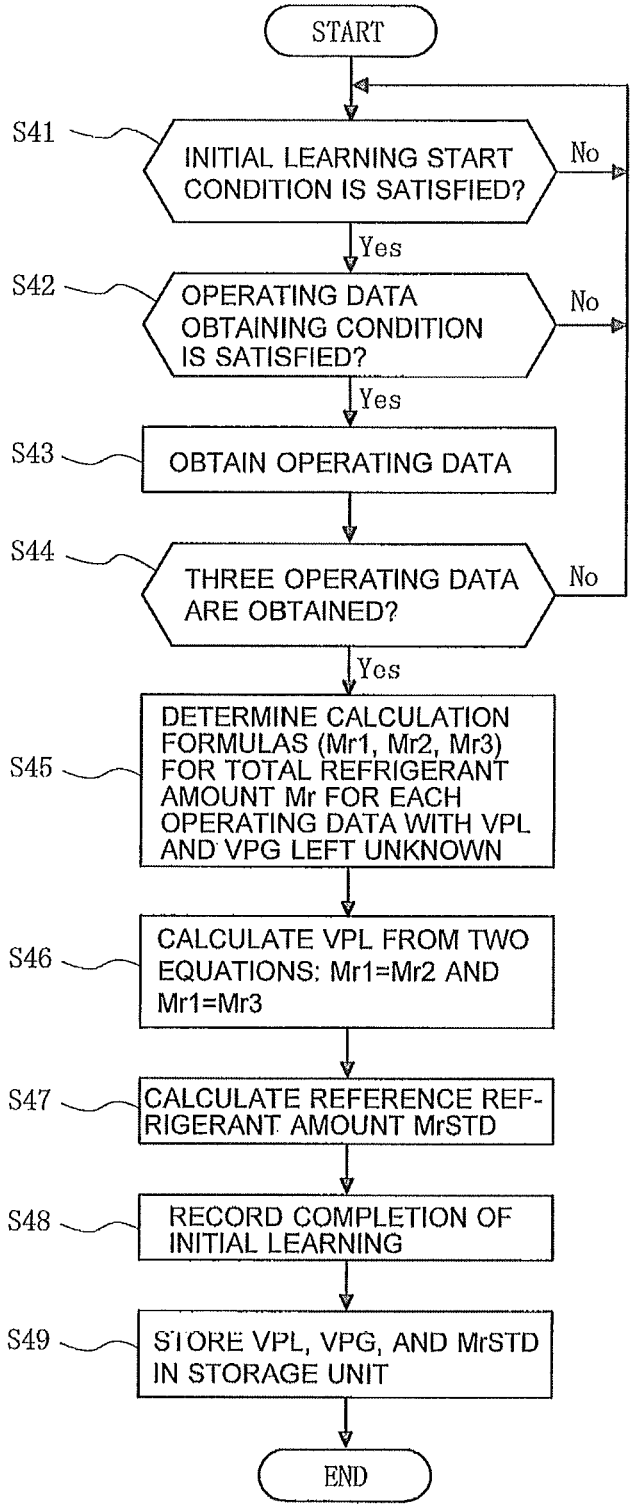
FIG. 7 is a flowchart of initial learning of the refrigeration and air-conditioning apparatus 1 according to Embodiment 2 of the invention.

FIG. 7 is a flowchart of the initial learning of the refrigeration and air-conditioning apparatus 1 according to Embodiment 2 of the invention.

In step S41, it is checked whether an initial learning condition is satisfied. Step S41 is the same as step S21 in FIG. 6 of Embodiment 1 and it is determined whether excess liquid refrigerant has accumulated in an accumulator 24. If it is determined that no excess liquid refrigerant is accumulated in the accumulator 24, the process goes to the next step S42.

In step S42, it is determined whether the current operating state satisfies a preset operation data obtaining condition. In Embodiment 2, at least three operation data obtaining conditions are set and, in step S43, each time the set of current operation data satisfies any one of the three operation data obtaining conditions, the control unit 3 automatically obtains and retains the set of operation data at the time. The three operation data obtaining conditions correspond to, for example, the case of the refrigerant temperature of the liquid refrigerant extension piping 6 at 30 degrees C., the case of the refrigerant temperature of the liquid refrigerant extension piping 6 at 20 degrees C., and the case of the refrigerant temperature of the liquid refrigerant extension piping 6 at 10 degrees C.

In step S44, it is determined whether three sets of data satisfying the operation data obtaining conditions has been obtained. If three sets of data satisfying the operation data obtaining conditions has not been obtained, the process goes back to step S42 to repeat the determinations of step S42 until three sets of data satisfying the operation data obtaining conditions are obtained. In contrast, if three sets of operation data satisfying the operation data obtaining conditions are obtained, the process goes to next step S45.

In step S45, a calculation formula for the total amount of refrigerant Mr is determined for each of the three sets of operation data stored in step S43. Since both the inner volume VPL of the liquid refrigerant extension piping 6 and the inner volume VPG of the gas refrigerant extension piping 7 are unknown, a calculation formula for the total amount of refrigerant Mr is determined for each of the sets of operation data with the inner volumes left unknown. When Mr1 denotes a total amount of refrigerant Mr obtained from the first set of operation data 1, Mr2 denotes a total amount of refrigerant Mr obtained from the second set of operation data 2, and Mr3 denotes a total amount of refrigerant Mr obtained from the third set of operation data 3, the respective calculation formulas are as follows:

$$Mr1=VPL\times\rho L1+VPG\times\rho G1+MA1$$

$$Mr2=VPL\times\rho L2+VPG\times\rho G2+MA2$$

$$Mr3=VPL\times\rho L3+VPG\times\rho G3+MA3$$

in which ρL1=refrigerant density of the liquid refrigerant extension piping 6 obtained from the set of operation data 1, ρG1=refrigerant density of the gas refrigerant extension piping 7 obtained from the set of operation data 1, MA1=an amount of refrigerant in the portion of the refrigerant circuit 10 other than the refrigerant extension piping obtained from the set of operation data 1, ρL2=refrigerant density of the liquid refrigerant extension piping 6 obtained from the set of operation data 2, ρG2=refrigerant density of the gas refrigerant extension piping 7 obtained from the set of operation data 2, MA2=amount of refrigerant in the portion of the refrigerant circuit 10 other than the refrigerant extension piping obtained from the set of operation data 2, ρL3=refrigerant density of the liquid refrigerant extension piping 6 obtained from the set of operation data 3, ρG3=refrigerant density of the gas refrigerant extension piping 7 obtained from the set of operation data 3, and MA3=amount of refrigerant in the portion of the refrigerant circuit 10 other than the refrigerant extension piping obtained from the set of operation data 3.

The calculation formulas for Mr1, Mr2, and Mr3 consist of known values calculable from the sets of operation data 1, 2, and 3 except for VPL and VPG.

In step S46, since the originally charged amounts of refrigerant is equal, the following two equations are created by using the fact that Mr1, Mr2, and Mr3 are all equal, and the simultaneous equations are solved to calculate the inner volume VPL of the liquid refrigerant extension piping 6 and the inner volume VPG of the gas refrigerant extension piping 7.

$$Mr1=Mr2$$

$$Mr1=Mr3$$

As described above, both the liquid refrigerant extension piping inner volume VPL and the gas refrigerant extension piping inner volume VPG can be calculated from at least three sets of operation data.

In step S47, the liquid refrigerant extension piping inner volume VPL and the gas refrigerant extension piping inner volume VPG calculated in step S46 are substituted in the calculation formula of Mr1 described above to calculate the total amount of refrigerant Mr1, and the total amount of refrigerant Mr1 is defined as the reference amount of refrigerant MrSTD.

In the process described above, the inner volume VPL of the liquid refrigerant extension piping 6, the inner volume VPG of the gas refrigerant extension piping 7, and the reference amount of refrigerant MrSTD are determined.

Finally, in step S48, the completion of the initial learning is recorded in a storage unit 3*c*. In step S49, the inner volume VPL of the liquid refrigerant extension piping 6, the inner volume VPG of the gas refrigerant extension piping 7, and the reference amount of refrigerant (when the initial charging amount is known, the initial charging amount) MrSTD calculated in the process are stored in the storage unit 3*c* to end the initial learning.

As described above, according to Embodiment 2, the same effects as Embodiment 1 are acquirable, and the respective inner volumes of the gas refrigerant extension piping 7 and the liquid refrigerant extension piping 6 can be calculated.

REFERENCE SIGNS LIST

1 refrigeration and air-conditioning apparatus; 2 outdoor unit; 3 control unit; 3*a* measuring unit; 3*b* calculating unit; 3*c* storage unit; 3*d* determining unit; 3*e* drive controlling unit; 3*f* displaying unit; 3*g* input unit; 3*h* output unit; 4A, 4B indoor unit (use unit); 6 liquid refrigerant extension piping; 6A liquid main pipe; 6*a* liquid branch pipe; 7 gas refrigerant extension piping; 7A gas main pipe; 7*a* gas branch pipe; 10 refrigerant circuit; 10*a* indoor side refrigerant circuit; 10*b* indoor side refrigerant circuit; 10*c* outdoor side refrigerant circuit; 10*z* main refrigerant circuit; 21 compressor; 22 four-way valve; 23 outdoor heat exchanger; 24 accumulator; 26 supercooler; 27 outdoor fan; 28 liquid side stop valve; 29 gas side stop valve; 31 outdoor side control unit; 32*a* indoor side control unit; 33*a* suction temperature sensor; 33*b* discharge temperature sensor; 33*c* outdoor temperature sensor; 33*d* liquid pipe temperature sensor; 33*e* liquid side temperature sensor; 33*f* gas side temperature sensor; 33*g* indoor temperature sensor; 33*h* liquid side temperature sensor; 33*i* gas side temperature sensor; 33*j* indoor temperature sensor; 33*k* heat exchange temperature sensor; 33*l* liquid side temperature sensor; 33*z* bypass temperature sensor; 34*a* suction pressure sensor; 34*b* discharge pressure sensor; 41A, 41B expansion valve; 42A, 42B indoor heat exchanger; 43A, 43B indoor fan; 51*a* distributer; 52*a* distributer; 71 bypass circuit; 72 bypass flow control valve.

The invention claimed is:

1. A refrigeration and air-conditioning apparatus comprising:

a refrigerant circuit including an outdoor unit that is a heat source unit and an indoor unit that is a use side unit connected through refrigerant extension piping;

a measuring unit that measures temperature and pressure of a main portion of the refrigerant circuit as operation data;

a calculating unit that has an operation data obtaining condition specifying an operating state and obtains, upon satisfaction of the operation data obtaining condition with respect to an operating state indicated by a set of operation data measured by the measuring unit during normal operation, the set of operation data at that time as a set of operation data for initial learning, the calculating unit calculating an inner volume of the refrigerant extension piping based on the obtained set of operation data for the initial learning and an initial charging amount that is a charging amount of refrigerant at the initial installation time of the refrigeration and air-conditioning apparatus, the calculating unit calculating a reference amount of refrigerant that is a criterion for determining refrigerant leakage from the refrigerant circuit based on the calculated inner volume of the refrigerant extension piping and the set of operation data for the initial learning; and a determining unit that calculates a total amount of refrigerant in the refrigerant circuit based on the inner volume of the refrigerant extension piping calculated by the calculating unit and a set of operation data measured by the measuring unit during normal operation, the determining unit comparing the calculated total amount of refrigerant with the reference amount of refrigerant to determine a presence or absence of refrigerant leakage, wherein the refrigerant extension piping includes a liquid refrigerant extension piping and a gas refrigerant extension piping, the normal operation is a cooling operation in which a superheat degree of the refrigerant at an outlet of an indoor heat exchanger of the indoor unit is controlled to adjust to a target value to cool indoor air by the indoor heat exchanger operating as an evaporator, or a heating operation in which a subcooling degree of the refrigerant at the outlet of the indoor heat exchanger of the indoor unit is controlled to adjust to a target value to heat indoor air by the indoor heat exchanger operating as a condenser, the calculating unit is configured to create a calculation formula for determining the total amount of the refrigerant in the refrigerant circuit, using an unknown inner volume of the liquid refrigerant extension piping, an inner volume of the gas refrigerant extension piping expressed by a relational expression for the inner volume of the liquid refrigerant extension piping, and the set of operation data for the initial learning obtained during the normal operation, to create an equation in which the total amount of refrigerant obtained from the calculation formula is equal to the initial charging amount, and to solve the equation to calculate the inner volume of the liquid refrigerant extension piping and the inner volume of the gas refrigerant extension piping as the inner volume of the refrigerant extension piping.

2. The refrigeration and air-conditioning apparatus of claim 1, wherein the calculating unit calculates a plurality of inner volumes of the refrigerant extension piping by changing the sets of operation data for the initial learning, and uses an average value of the calculation results to calculate the reference amount of refrigerant and the total amount of refrigerant in the refrigerant circuit.

3. The refrigeration and air-conditioning apparatus of claim 2, wherein when the average value is calculated from the plurality of calculation results of the inner volume of the refrigerant extension piping, the calculating unit determines whether each of calculation results is a calculation result in a state without refrigerant leakage and calculates the average value by using only calculation results in a state without refrigerant leakage.

4. The refrigeration and air-conditioning apparatus of claim 1, wherein the calculating unit calculates the inner volume of the refrigerant extension piping based on a set of operation data when a compressor operating capacity is equal to or greater than a predetermined value.

5. The refrigeration and air-conditioning apparatus of claim 1, wherein the calculating unit calculates the inner volume of the refrigerant extension piping based on a set of operation data when an outdoor temperature is equal to or greater than a predetermined temperature.

6. The refrigeration and air-conditioning apparatus of claim 1, wherein the calculating unit calculates the inner volume of the refrigerant extension piping based on a set of operation data when a compressor operating capacity is equal to or greater than a predetermined value and an outdoor temperature is equal to or greater than a predetermined temperature.

7. The refrigeration and air-conditioning apparatus of claim 1, wherein the determining unit calculates the total amount of refrigerant in the refrigerant circuit based on a set of operation data when a compressor operating capacity is equal to or greater than a predetermined value, and uses the total amount to determine the presence or absence of refrigerant leakage.

8. The refrigeration and air-conditioning apparatus of claim 1, wherein the determining unit calculates the total amount of refrigerant in the refrigerant circuit based on a set of operation data when an outdoor temperature is equal to or greater than a predetermined temperature, and uses the total amount to determine the presence or absence of refrigerant leakage.

9. The refrigeration and air-conditioning apparatus of claim 1, wherein the determining unit calculates the total amount of refrigerant in the refrigerant circuit based on a set of operation data when a compressor operating capacity is equal to or greater than a predetermined value and an outdoor temperature is equal to or greater than a predetermined temperature, and uses the total amount to determine the presence or absence of refrigerant leakage.

10. The refrigeration and air-conditioning apparatus of claim 1, further comprising an output unit that transmits a determination result of the determining unit to the outside.

11. A refrigeration and air-conditioning apparatus comprising:

a refrigerant circuit including an outdoor unit that is a heat source unit and an indoor unit that is a use side unit connected through refrigerant extension piping;

a measuring unit that measures temperature and pressure of refrigerant in the refrigerant circuit as operation data;

a calculating unit that has at least two operation data obtaining conditions, each specifying an operation state and obtains, upon satisfaction of the operation data obtaining condition with respect to an operating state indicated by a set of operation data measured by the measuring unit during normal operation, the set of operation data at that time as a set of operation data for initial learning, the calculating unit calculating an inner volume of the refrigerant extension piping based on the obtained at least two sets of operation data for the initial learning, the calculating unit calculating a reference amount of refrigerant that is a criterion for determining refrigerant leakage from the refrigerant circuit based on the calculated inner volume of the refrigerant extension piping and any one of the at least two sets of operation data for the initial learning; and a determining unit that calculates a total amount of refrigerant in the refrigerant circuit based on the inner volume of the refrigerant extension piping calculated by the calculating unit and a set of operation data measured by the measuring unit during normal operation, the determining unit comparing the calculated total amount of refrigerant with the reference amount of refrigerant to determine a presence or absence of refrigerant leakage, wherein the refrigerant extension piping includes a liquid refrigerant extension piping and a gas refrigerant extension piping, the normal operation is a cooling operation in which a superheat degree of the refrigerant at an outlet of an indoor heat exchanger of the indoor unit is controlled to adjust to a target value to cool indoor air by the indoor heat exchanger operating as an evaporator, or a heating operation in which a subcooling degree of the refrigerant at the outlet of the indoor heat exchanger of the indoor unit is controlled to adjust to a target value to heat indoor air by the indoor heat exchanger operating as a condenser, the calculating unit is configured to create a calculation formula for determining the total amount of the refrigerant in the refrigerant circuit for each set of operation data for the initial learning obtained during the normal operation, using an unknown inner volume of the liquid refrigerant extension piping and an inner volume of the gas refrigerant extension piping expressed by a relational expression for the inner volume of the liquid refrigerant extension piping, to create an equation in which the total amount of refrigerant obtained from each calculation formula is equal, and to solve the equation to calculate the inner volume of the liquid refrigerant extension piping and the inner volume of the gas refrigerant extension piping as the inner volume of the refrigerant extension piping.

12. The refrigeration and air-conditioning apparatus of claim 11, wherein the at least two operation data obtaining conditions specify operating states that differ in the densities of the refrigerant in the refrigerant extension piping from one another.

13. The refrigeration and air-conditioning apparatus of claim 12, wherein the refrigerant extension piping includes a liquid refrigerant extension piping and a gas refrigerant extension piping, and the at least two operation data obtaining conditions specify operating states that differ in densities of liquid refrigerant flowing in the liquid refrigerant extension piping.

14. A refrigeration and air-conditioning apparatus comprising:

a refrigerant circuit including an outdoor unit that is a heat source unit and an indoor unit that is a use side unit connected through refrigerant extension piping;

a measuring unit that measures temperature and pressure of refrigerant in the refrigerant circuit as operation data;

a calculating unit that has at least two operation data obtaining conditions each specifying an operation state and obtains, upon satisfaction of the operation data obtaining condition with respect to an operating state indicated by a set of operation data measured by the measuring unit during normal operation, the set of operation data at that time as a set of operation data for initial learning, the calculating unit calculating an inner volume of the refrigerant extension piping based on the obtained at least two sets of operation data for the initial learning, the calculating unit calculating a reference amount of refrigerant that is a criterion for determining refrigerant leakage from the refrigerant circuit based on the calculated inner volume of the refrigerant extension piping and any one of the at least two sets of operation data for the initial learning; and a determining unit that calculates a total amount of refrigerant in the refrigerant circuit based on the inner volume of the refrigerant extension piping calculated by the calculating unit and a set of operation data measured by the measuring unit during normal operation, the determining unit comparing the calculated total amount of refrigerant with the reference amount of refrigerant to determine a presence or absence of refrigerant leakage, wherein the refrigerant extension piping includes a liquid refrigerant extension piping and a gas refrigerant extension piping, the normal operation is a cooling operation in which a superheat degree of the refrigerant at an outlet of an indoor heat exchanger of the indoor unit is controlled to adjust to a target value to cool indoor air by the indoor heat exchanger operating as an evaporator, or a heating operation in which a subcooling degree of the refrigerant at the outlet of the indoor heat exchanger of the indoor unit is controlled to adjust to a target value to heat indoor air by the indoor heat exchanger operating as a condenser, the calculating unit is configured to create a calculation formula for determining the total amount of the refrigerant in the refrigerant circuit for each set of operation data for the initial learning, using an unknown inner volume of the liquid refrigerant extension piping and an unknown inner volume of the gas refrigerant extension piping, to create, with at least three operation data for initial learning, at least two equations in which the total amount of refrigerant obtained from each of the calculation formulas is equal, and to solve the simultaneous equations to calculate the inner volume of the liquid refrigerant extension piping and the inner volume of the gas refrigerant extension piping as the inner volume of the refrigerant extension piping.

* * * * *